US009813791B1

(12) United States Patent
Cloud

(10) Patent No.: US 9,813,791 B1
(45) **Date of Patent: *Nov. 7, 2017**

(54) ACTIVE PHANTOM-POWERED RIBBON MICROPHONE WITH SWITCHABLE PROXIMITY EFFECT RESPONSE FILTERING FOR VOICE AND MUSIC APPLICATIONS

(71) Applicant: Rodger Cloud, Tuscon, AZ (US)

(72) Inventor: Rodger Cloud, Tuscon, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,632

(22) Filed: Dec. 7, 2015

Related U.S. Application Data

(63) Continuation of application No. 14/158,863, filed on Jan. 19, 2014, now Pat. No. 9,210,508, which is a continuation-in-part of application No. 13/655,840, filed on Oct. 19, 2012, now Pat. No. 9,306,519, and a continuation-in-part of application No. 13/854,839, filed on Apr. 1, 2013, now Pat. No. 9,167,327.

(51) Int. Cl.

| | |
|---|---|
| ***H04R 3/00*** | (2006.01) |
| ***H04R 1/04*** | (2006.01) |
| ***H04R 3/10*** | (2006.01) |
| ***H04R 1/06*** | (2006.01) |

(52) U.S. Cl.
CPC ..... *H04R 1/04* (2013.01); *H04R 1/06* (2013.01); *H04R 3/10* (2013.01)

(58) Field of Classification Search
CPC ..... H04R 3/00; H04R 3/10
USPC ..... 381/104, 109, 111–115, 120, 122, 123
See application file for complete search history.

(56) References Cited

U.S. PATENT DOCUMENTS

| | | | | |
|---|---|---|---|---|
| 2003/0076967 | A1* | 4/2003 | Hohendahl | H03F 1/22 381/120 |
| 2005/0220314 | A1* | 10/2005 | Lang | H04R 3/00 381/113 |
| 2006/0078134 | A1* | 4/2006 | Khenkin | H04R 3/00 381/113 |
| 2007/0263883 | A1* | 11/2007 | Jakowski | H04R 3/00 381/110 |
| 2012/0140944 | A1* | 6/2012 | Thiele | H04R 3/00 381/77 |

(Continued)

*Primary Examiner* — Katherine Faley
(74) *Attorney, Agent, or Firm* — Invent Capture, LLC.; Samuel S. Cho

(57) ABSTRACT

Novel active phantom-powered ribbon microphones that provide switchable proximity effect response filtering for voice and music applications are disclosed with unique adjustable interfaces. In one embodiment of the invention, a slider-based full frequency response vs. low frequency response and high pass filtering adjustment interface on a surface of a microphone casing provides a convenient switching between a "Music" mode and a "Voice" mode, wherein the "Voice" mode reduces the undesirable proximity effect in an active phantom-powered ribbon microphone, when a sound source is situated overly close to the active phantom-powered ribbon microphone. Furthermore, in one embodiment of the invention, a slider-based or a knob-based variable voice mode adjustment interface can also be integrated on a surface of a microphone casing to provide various preset levels of low frequency reduction and/or proximity effect response filtering when the "Voice" mode is enabled.

20 Claims, 27 Drawing Sheets

Preamp Circuit with XFMR and high-pass filter

(56) References Cited

U.S. PATENT DOCUMENTS

2013/0089208 A1* 4/2013 Fairey ..... H04R 5/04
381/17

* cited by examiner

100

200

300

400

500

600

700A

700B

700C

700D

800A

800B

800C

800D

901

902

903

1001

1002

1003

1101

1102

1201

1202

1300A

1300B 1400A 1400B 1501 1502

1600A 1600B 1700A 1700B

Preamp Circuit with C1

1800

Preamp Circuit without C1

1900

Preamp Circuit without high-pass filter

2000

Preamp Circuit with XFMR and high-pass filter

"Voice" setting

2200

1/3 Octave Band Center Frequency, Hz

"Music" setting

2300

2400

2500

2600

2700

ACTIVE PHANTOM-POWERED RIBBON MICROPHONE WITH SWITCHABLE PROXIMITY EFFECT RESPONSE FILTERING FOR VOICE AND MUSIC APPLICATIONS

BACKGROUND OF THE INVENTION

Ribbon microphones once dominated commercial broadcasting and recording industries as a preferred high-end microphone technology. First invented by Walter H. Schottky and Dr. Erwin Gerlach and further developed by Dr. Harry F. Olson of RCA corporation in the late 1920's, Ribbon microphones widely commercialized in the 1930's exhibited superior frequency responses and higher-fidelity output signals compared to other microphones of the time.

A ribbon microphone typically uses a thin piece of metal immersed in magnetic field generated by surrounding magnets. The thin piece of metal is generally called a "ribbon" and is often corrugated to achieve wider frequency response and fidelity. Ribbon microphones became vastly popular and became a primary broadcasting and recording microphone until mid-1970's.

However, the classic ribbon microphone architecture was susceptible to significant disadvantages. First, a typical ribbon microphone contained a fragile ultra-thin ribbon, typically made of corrugated aluminum, which could break easily if the ribbon microphone casing was subject to a gust of air through its microphone windscreen. Second, most ribbon microphones could not produce as high output signal level as condenser or dynamic moving-coil microphones. The lack of high output signal level for ribbon microphones usually required careful pre-amplification matching and tuning, which was cumbersome and contributed to reduced ruggedness and reliability compared to condenser and other dynamic microphones.

By the mid-1970's, dynamic moving-coil microphones (i.e. coil wire on a diaphragm suspended over a magnetic field) and condenser microphones (i.e. capacitor microphones) evolved technologically for higher sensitivity and signal-to-noise ratio (SNR) to compete effectively against ribbon microphones. For example, improved condenser microphones exhibited substantially higher output signal level than ribbon microphones, thereby simplifying pre-amplification process and improving reliability of recording or broadcasting equipment.

Although a typical condenser microphone had the tendency of exaggerating upper frequency ranges whenever inherent harmonic resonances occurred in a diaphragm of the microphone, the exaggerated upper frequency was actually preferred by some since the recording industry exclusively used analog tape mediums for audio recording. Most analog tapes suffered generational signal losses and could not accurately capture high-frequency ranges, which made the use of condenser microphone-based recording equipment more acceptable. Similarly, although dynamic moving-coil microphones fundamentally possessed higher resistivity to sound waves than ribbon microphones, improved dynamic moving-coil and condenser microphones provided ways to compensate for a relatively low high-frequency response. Therefore, by the mid-1970's, most ribbon microphones were rapidly replaced by more portable, rugged, and user-friendly condenser and dynamic moving-coil microphones. By the end of that decade, ribbon microphones were widely considered obsolete.

However, despite several drawbacks as mentioned above, ribbon microphones possess fundamental advantages as recording and broadcasting industry become fully adjusted to the digital era. As Compact Discs and solid-state non-volatile memory (e.g. NAND flash memory) became recording media of choice for highly digitized recording and broadcasting equipment, the high-frequency exaggeration and distortion provided by condenser microphones were no longer desirable. Many audio engineers and music lovers began to favor more natural and linear reproduction of sound, which meant that ribbon microphone's fundamentally higher fidelity in higher frequencies received attention once again. Ribbon microphones also provide a generally richer and fuller sound reproduction compared to condenser and dynamic moving-coil microphones with digital audio recording and broadcasting equipment. In recent years, there has been a resurgence of demand for retrofitted ribbon microphones of yore and a need for newly-designed ribbon microphones, especially in the high-end audio industry.

Unfortunately, ribbon microphones typically still exhibit an undesirable trait called "proximity effect," which may prevent their widespread application. In particular, when a musician, a singer, or another sound source is situated very close to a ribbon microphone, the ribbon microphone tends to dramatically increase the bass (i.e. lower frequency) response disproportionately, compared to the higher frequencies above the bass range. In the field of audio engineering, this is generally known as the "proximity effect." The disproportionate bass response relative to higher frequencies may get progressively worse, resulting in an accentuated bass effect, if the sound source is moved closer to the ribbon microphone during a musical performance or a recording session.

The proximity effect in a ribbon microphone may distort sound production quality to be overly "dark," or provide inadequate higher frequency responses, depending on a current distance between a sound source and the ribbon microphone. Utilizing ribbon microphones in some sound production and recording environment sometimes necessitate substantial frequency manipulation with an equalizer to mitigate the proximity effect.

Therefore, it may be beneficial to provide a novel ribbon microphone or another type of microphone that minimizes or removes the proximity effect within the casing of the microphone. Furthermore, it may be beneficial to provide a convenient user interface that enables the user to switch between a voice application and a music application to mitigate the proximity effect. In addition, it may be beneficial to provide a novel microphone and a user interface for switching between the voice application and the music application with an actively-powered preamplifier integrated inside the casing of the microphone. Furthermore, it may also be beneficial to provide a novel standalone inline preamplifier with a user interface for switching between the voice application and the music application with proximity effect filtering.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, an integrated phantom-powered inline preamplifier with proximity effect response filtering inside an active ribbon or dynamic microphone casing is disclosed. This integrated phantom-powered inline preamplifier comprises: a set of input terminals coupled to the active ribbon or dynamic microphone casing, wherein the set of input terminals are configured to receive a microphone electrical signal from a passive circuitry in the active ribbon or dynamic microphone casing, and wherein the set of input terminals is also coupled to one or more transistors inside the integrated phantom-powered inline preamplifier; a set of output terminals configured to load phantom power and also configured to transmit an amplified signal from the microphone electrical signal, wherein the set of output terminal is coupled to the one or more transistors inside the integrated phantom-powered inline preamplifier; a phantom-powered preamplifier gain circuit comprising at least one of the one or more transistors and a resistor-capacitor network; a full frequency response and low frequency response adjustment interface that activates a full frequency response mode or a high-pass filter mode; and a high-pass filter circuit coupled to the full frequency response and low frequency response adjustment interface, wherein the high-pass filter circuit is integrated inside the active ribbon or dynamic microphone casing.

In another embodiment of the invention, a standalone phantom-powered inline preamplifier with proximity effect response filtering is disclosed. This standalone phantom-powered inline preamplifier comprises: a set of input terminals on a casing of the standalone phantom-powered inline preamplifier, wherein the set of input terminals are configured to receive a sound source electrical signal from a microphone or another sound input source, and wherein the set of input terminals is coupled to one or more transistors inside the standalone phantom-powered inline preamplifier; a set of output terminals configured to load phantom power and also configured to transmit an amplified signal from the sound source electrical signal, wherein the set of output terminal is coupled to the one or more transistors inside the standalone phantom-powered inline preamplifier; a phantom-powered preamplifier gain circuit comprising at least one of the one or more transistors and a resistor-capacitor network; a full frequency response and low frequency response adjustment interface that activates a full frequency response mode or a high-pass filter mode; and a high-pass filter circuit coupled to the full frequency response and low frequency response adjustment interface, wherein the high-pass filter circuit is integrated inside the standalone phantom-powered inline preamplifier.

BRIEF DESCRIPTION OF DRAWINGS

Implementations of the invention will become more apparent from the detailed description set forth below when taken in conjunction with the drawings, in which like elements bear like reference numerals.

DETAILED DESCRIPTION

Figure 1:
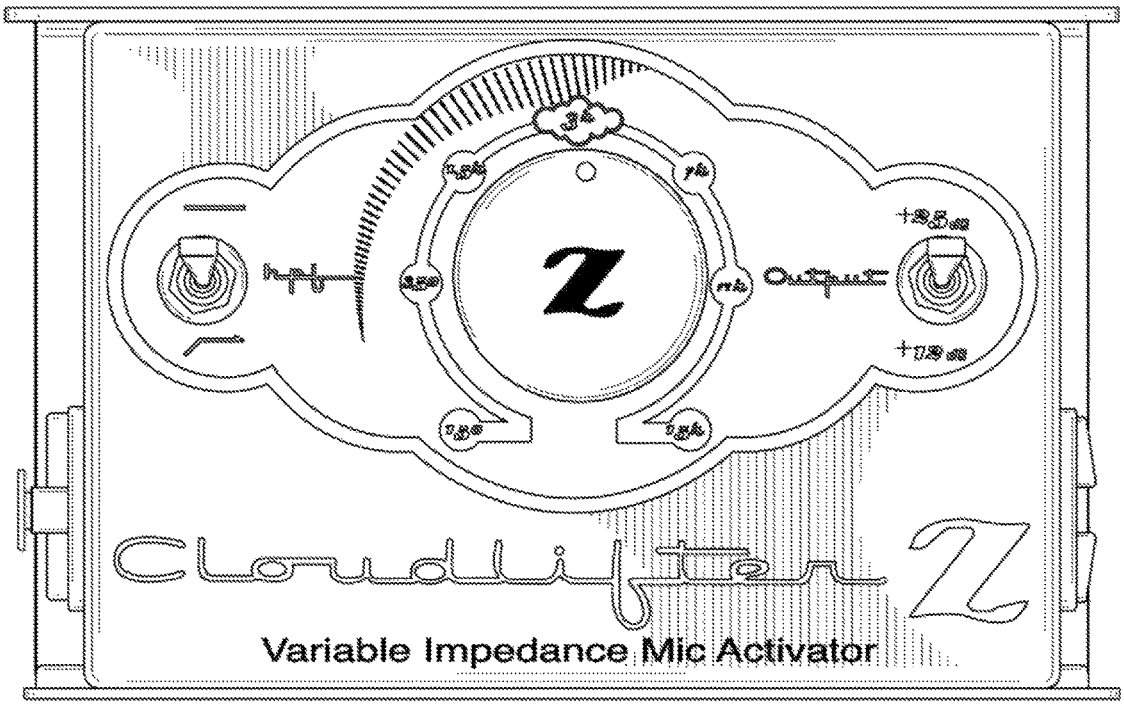
FIG. 1 shows a front perspective view of a standalone phantom-powered inline preamplifier unit with a variable impedance loading adjustment interface, in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble an active phantom-powered ribbon microphone with switchable proximity effect response filtering for voice and music application. In a preferred embodiment of the invention, this switchable proximity effect response filtering is achieved by a phantom-powered integrated preamplifier with a capacitor filtering system and/or a variable impedance loading circuitry, which are incorporated in an active ribbon microphone. These process descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

In general, embodiments of the invention relate to a ribbon microphone. More specifically, an embodiment of the invention relates to an active phantom-powered ribbon microphone with switchable proximity effect response filtering for voice and music application. Furthermore, an embodiment of the invention also relates to a user interface that enables switching between a voice application and a music application to select an appropriate proximity effect response filtering. In a preferred embodiment of the invention, this switchable proximity effect response filtering may be based on a phantom-powered integrated preamplifier with a capacitor filtering system and/or a variable impedance loading circuitry, which is built into an active ribbon microphone.

Furthermore, one objective of an embodiment of the invention is to provide a novel ribbon microphone that minimizes or removes the proximity effect within the casing of the ribbon microphone.

Another objective of an embodiment of the invention is to provide a convenient user interface that enables the user to switch between a voice application and a music application to mitigate the proximity effect, or to optimize the frequency response range that the user is desiring to achieve.

Yet another objective of an embodiment of the invention is to provide a novel ribbon microphone and an associated user interface for switching between the voice application and the music application with a phantom-powered active preamplifier integrated inside the casing of the ribbon microphone.

For the purpose of describing the invention, an "active microphone" is defined as a microphone with an integrated preamplifier, wherein the integrated phantom-powered inline preamplifier contains active electrical circuitry to amplify electrical signal produced by a passive electrical circuit portion of the microphone.

In addition, for the purpose of describing the invention, a "passive microphone" is defined as a microphone with passive electrical circuitry without powered components, such as integrated phantom-powered inline preamplifier, inside a microphone casing. Typically, an electrical signal outputted from a passive microphone is entirely originating from a sound pressure impacting a microphone component, such as a thin corrugated ribbon (i.e. in case of a ribbon microphone) or a diaphragm (i.e. in case of a dynamic microphone), wherein the movements of a certain microphone component induce electrical signals via a transducer. In a passive microphone, this induced electrical signal may be further transformed via passive circuitry in a microphone casing and then outputted to an output terminal, which may be connected to a standalone phantom-powered inline preamplifier unit for signal amplification.

Furthermore, for the purpose of describing the invention, "variable impedance loading" is defined as varying input impedance or internal impedance of a standalone phantom-powered inline preamplifier or an integrated phantom-powered inline preamplifier for electrical signals received from a passive microphone or a passive circuit portion of an active microphone. In general, the variable impedance loading is related to resistive impedance-based variable loading effects, wherein one or more resistors and/or a potentiometer operatively connected to an adjustable interface (e.g. a knob, a slider, a roller, a switch, and etc.) change resistive input impedance of the phantom-powered inline preamplifier. In a preferred embodiment of the invention, varying input resistive impedance or internal impedance of a standalone phantom-powered inline preamplifier for the electrical signals received form a passive microphone or a passive circuit portion of an active microphone produces customized, desired, and/or adjustable sound characteristics at the phantom-powered inline preamplifier stage.

Moreover, for the purpose of describing the invention, "proximity effect" is defined as a disproportionate, uneven, or undesirable frequency response across a spectrum of frequency response ranges by a microphone due to a close distance of a sound source to the microphone. For example, a singer, an instrument, or another sound source situated very close to a conventional ribbon microphone can disproportionately increase bass response relative to higher frequency response ranges in the conventional ribbon microphone, thereby creating an unintentionally accentuated bass response. In many cases, a disproportionate frequency response within a spectrum of frequency response ranges for a microphone may worsen if the sound source gets closer to the microphone.

In addition, for the purpose of describing the invention, "proximity effect response filtering" is defined as reducing, mitigating, and/or avoiding an undesirable and/or unintended effect on a microphone's frequency response due to a close proximity between the microphone and a sound source, such as a singer, a speaker, a musical instrument, or another sound source generating sound waves into the microphone. Preferably, the proximity effect response filtering is achieved by a phantom-powered integrated preamplifier with a capacitor filtering system and/or a variable impedance loading circuitry, which are incorporated in an active ribbon microphone.

Audio preamplifiers are important components in sound recording, reproduction, or audio for live concerts or events. In general, an audio preamplifier takes an electrical signal generated from a microphone or another sound source as an input, and further processes and amplifies this input signal to generate a desirable level of amplified electrical signal to other components such as main amplifiers, speakers, or recording equipment.

Preamplifiers take an important role in determining amplified and/or reproduced sound characteristics of the sound source, because it is generally the first actively-powered stage for the electrical signal generated from the microphone or another sound source, which are highly vulnerable to undesirable distortions or noise introduced during any amplification stages. For example, an undesirable introduction of distortions or noise at or before the preamplifier stage may be magnified by subsequent amplification stages, thereby making post-preamplifier stage correction difficult and exacerbating any problems from the preamplifier to recording equipment or a listener.

In audio industry, impedance matching or bridging between a microphone and a preamplifier has been an important requirement for high fidelity electrical signal transmission between an output from the microphone and an input to the preamplifier. In general, the output from the microphone is an electrical signal which typically undergoes signal transformation through a transformer unit inside the microphone circuitry. It is desirable to have the impedance of this output terminal from the microphone match or appropriately bridge the impedance of the preamplifier for high fidelity electrical signal transmission between the microphone and the preamplifier. For example, the resistive impedance matching may involve keeping the impedance load value to be 3-10 times the value of a passive microphone's output transformer. In case of transformer-coupled preamplifiers, it may be desirable to match the actual impedance values (e.g. 150 ohm-output from a passive microphone's transformer to 150 ohm-input of a preamplifier's input transformer).

Conventional methods of impedance matching or bridging between the microphone and the preamplifier include using a commonly-used impedance value at the output of the microphone and the input of the preamplifier. A less used but another conventional method of impedance matching or bridging between the microphone and the preamplifier is varying the output impedance value of a passive microphone by adjusting the microphone's passive circuitry before the output of the passive microphone is transmitted to any active power elements or a preamplifier.

These conventional methods of impedance matching or bridging are typically only used for efficient signal transmission between the microphone and the preamplifier, and are not designed to produce customized effects for various sound characteristics at a preamplifier stage. Because the preamplifier is generally the first stage for active circuit processing of a sound source signal (e.g. a passive microphone electrical signal), certain customized effects for sound characteristics (e.g. an emphasis on a mid-range audible frequency, an emphasis on treble or bass, or other intended sound effects) may be best obtained at the preamplifier stage without causing significant amount of undesirable noise or distortion to the sound source signal.

Furthermore, because conventional ribbon microphones typically exhibit an undesirable trait called "proximity effect" that hampers convenient and widespread application, it may be advantageous to provide a user-adjustable proximity effect response filtering and a corresponding user interface to mitigate the proximity effect. For a conventional ribbon microphone, when a musician, a singer, or another sound source is situated very close to the conventional ribbon microphone, the conventional ribbon microphone tends to dramatically increase the bass (i.e. lower frequency) response disproportionately, compared to the higher frequencies above the bass range.

The disproportionate bass response relative to higher frequencies may get progressively worse, resulting in an accentuated bass effect, if the sound source is moved closer to the conventional ribbon microphone during a musical performance or a recording session. The proximity effect in the conventional ribbon microphone may distort sound production quality to be overly "dark," or provide inadequate higher frequency responses, depending on a current distance between a sound source and the ribbon microphone. Utilizing conventional ribbon microphones in some sound production and recording environment sometimes necessitate substantial frequency manipulation with an equalizer to mitigate the proximity effect.

Therefore, various embodiments of the present invention discloses a novel, phantom-powered active ribbon microphone that minimizes or removes the proximity effect within the casing of the ribbon microphone. This novel phantom-powered active ribbon microphone provides a convenient user interface that provides either a switchable and/or a sweepable selection between a voice application and a music application to mitigate the proximity effect.

FIG. 1 shows a front perspective view of a standalone phantom-powered inline preamplifier unit (100) with a variable impedance loading adjustment interface, in accordance with an embodiment of the invention. In general, variable impedance loading is related to resistive impedance-based variable loading effects, wherein one or more resistors and/or potentiometer operatively connected to an adjustable interface (e.g. a knob, a slider, a roller, a switch, and etc.) change resistive input impedance of the phantom-powered inline preamplifier. In a preferred embodiment of the invention, the standalone phantom-powered inline preamplifier unit has a knob as an adjustable interface for adjusting variable impedance loading value of the standalone phantom-powered inline preamplifier unit (100). In the preferred embodiment of the invention, the impedance loading value may be adjusted within a range from 150 ohms to 15,000 ohms. In another embodiment of the invention, the impedance loading value may be wider, narrower, or a subset of the range of the preferred embodiment of the invention.

In the preferred embodiment of the invention, setting the phantom-powered inline preamplifier to a low impedance loading value may emphasize mid-range audible frequency of sound over treble and/or bass, which may be desired for certain musical instruments or recording environment. For example, classical music recordings or performances, which may benefit by emphasizing mid-range audible frequency, can utilize a lower impedance loading value setting (e.g. 1.5k ohms) for optimal sound recording or live concert production environment. The optimal value will vary depending on the microphone's output impedance. In general, with a higher impedance output, the optimal value may be higher. By varying impedance loading value settings, the resulting loading effects enable a user to customize and fine-tune desirable sound characteristics through the phantom-powered inline preamplifier.

On the other hand, setting the phantom-powered inline preamplifier to a high impedance loading value may increase frequency response over a broader audible frequency ranges, thereby giving an effect of stronger bass and treble in sound recording or live concert production environment. Therefore, a rock, pop, or jazz concert or recording may benefit from adjusting the impedance loading value of the phantom-powered inline preamplifier to a high impedance loading value setting (e.g. 3,000 ohms, 5,000 ohms, or higher). For example, a microphone with a 1000-ohm output impedance may sound more natural at around 10 k-ohms. In another example, a microphone with a lower impedance like 50 or 150 ohms, may sound elevated in the bass and slightly more aggressive in the top.

Impedances loading values which fall outside the range of commonly-used impedance values may produce interesting sound characteristics. For example, a very low impedance loading value may deemphasize bass and/or treble too much to produce desirable sound effects in many cases. Loading with a very low impedance may deemphasize the bass and/or treble, producing a sound with a forward midrange. However, this could be desirable in the case of an electric guitar or other source where a high amount of mid-range focus is desired. Furthermore, a very high impedance loading value may emphasize more bass and/or treble too much to make resulting sound overly bright or harsh. However, in some applications, a user may want this sound effect to produce full and crisp sound. The advantage of various embodiments of the present invention is enabling a user to set his/her own preferred impedance loading value from the phantom-powered inline preamplifier unit, depending on a particular sound production/recording environment, output impedance characteristics of the microphone, and a particular source of sound (e.g. vocal, piano, bass drum, violin, guitar, and etc.).

Phantom-powered inline preamplifiers generally utilize another preamplifier operatively connected to the phantom-powered inline preamplifier, wherein the other preamplifier provides phantom power (e.g. 48 V, 24 V, etc.). With the phantom-powered inline preamplifier, the secondary preamplifier may only need to produce a smaller amount of amplification (e.g. 10-20 dB), because the inline preamplifier is providing some good amount of gain (e.g. 20 dB). Phantom-powered inline preamplifiers may be highly usefully in enabling the secondary preamplifier and/or other mixer interfaces to operate in their "sweetspot" gain ranges. For example, many secondary preamplifiers sound great when providing 20 dB of gain, but significantly deteriorate past 30-40 dB of gain.

It should be noted that conventional preamplifiers are not typically phantom-powered. Furthermore, conventional preamplifiers generally do not provide an inline preamplifier configuration, and if phantom-powered, they do not provide means or interfaces to adjust impedance loading values for electrical signals generated from a passive microphone, a passive portion of the microphone, or another sound source. At best, a conventional microphone may have passive circuit-based impedance adjustment for a microphone's output terminal to accommodate impedance matching between the microphone and the preamplifier connection. The conventional impedance matching is merely utilized for effective transmission of electrical signals from the passive microphone to the preamplifier unit. In contrast, various embodiments of the present invention are concerned with adjusting an interaction between an output signal from a passive circuitry portion of a microphone or another sound source and an initial impedance loading and gain by utilizing active (i.e. phantom powered) circuitry for a user's desired and customized sound effects, with impedance matching or bridging already established between the microphone and the preamplifier (e.g. transformer load matching, and etc.).

Continuing with FIG. 1, in one embodiment of the invention, the standalone phantom-powered inline preamplifier unit with the knob for impedance loading adjustment may additionally include one or more adjustable interfaces for other electrical parameters, such as variable high-pass filtering (VARI-HPF), transformer impedance matching (XFMR) between the phantom-powered inline preamplifier unit and the microphone, and variable output gain for output from the phantom-powered inline preamplifier unit. Furthermore, the standalone phantom-powered inline preamplifier unit also includes a power connection input jack (i.e. to receive power from phantom power from the output microphone cable fed from a secondary preamplifier supplying 48 V phantom power) and a microphone/sound source connection input jack (i.e. to receive an electrical signal from the microphone or another sound source).

In a preferred embodiment of the invention, the standalone phantom-powered inline preamplifier unit is configured to receive DC phantom power to power its active circuitry and amplifies the electrical signal from the microphone or from another sound source up to 25 db, with variable impedance loading adjustment and optionally other parameter adjustment capabilities. Furthermore, in one embodiment of the invention, the electrical signal that the standalone phantom-powered inline preamplifier unit amplifies may be originating from a musical instrument such as an acoustic guitar, a classical instrument, a bass instrument, or another electric or acoustic instrument equipped with an onboard transducer or sound pickup system. If the sound source of the electrical signal is coming from a musical instrument, then a sweep-selectable or selectable variable impedance range may be typically higher than what is used for a microphone as a sound source. For example, 1 kilo-ohms to 2 mega-ohms sweep-selectable or selectable variable impedance range may be more appropriate for at least some of the musical instruments to accommodate a higher-impedance instrument amplifier. Moreover, in another embodiment of the invention, the electrical signal that the standalone phantom-powered inline preamplifier unit amplifies may be originating from a phonograph or another source of sound which requires amplification.

Figure 2:
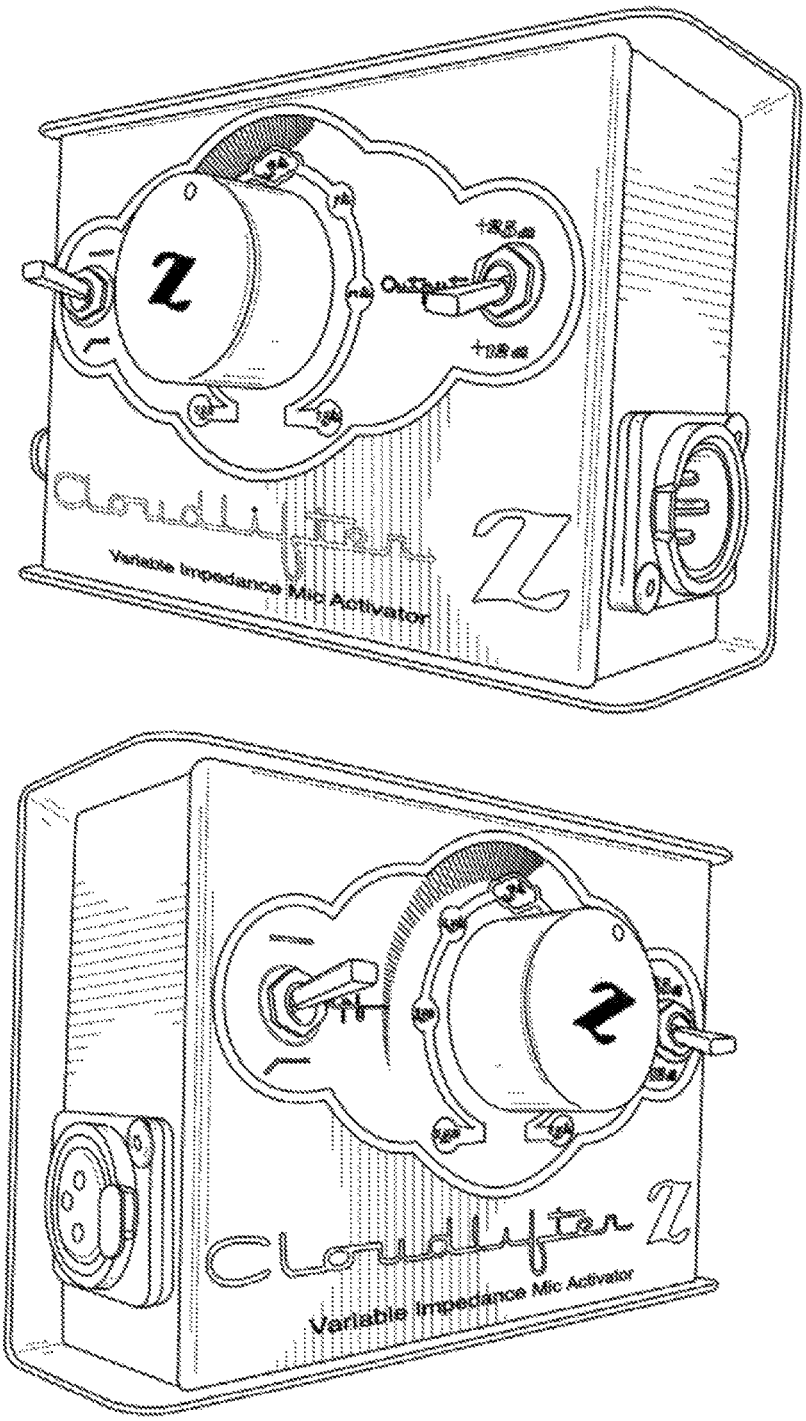
FIG. 2 shows a side perspective view of a standalone phantom-powered inline preamplifier unit with a variable impedance loading adjustment interface, in accordance with an embodiment of the invention.

FIG. 2 shows a side perspective view (200) of a standalone phantom-powered inline preamplifier unit with a variable impedance loading adjustment interface, in accordance with an embodiment of the invention. In one embodiment of the invention, a side portion or a rear portion of the standalone phantom-powered inline preamplifier unit may have one or more input/output terminals for variety of electrical connections, such as a power connection input jack (e.g. phantom power connection) and a microphone/sound source connection input jack. The side portion or the rear portion of the standalone phantom-powered inline preamplifier unit may also contain have one or more adjustable interfaces for variable impedance loading, variable high-pass filtering (VARI-HPF), transformer impedance matching (XFMR), and variable output gain for output from the phantom-powered inline preamplifier unit. In another embodiment of the invention, a front portion of the standalone phantom-powered inline preamplifier (e.g. 100 of FIG. 1) may contain most or all of the electrical connection interfaces as well as adjustment interfaces.

Figure 3:
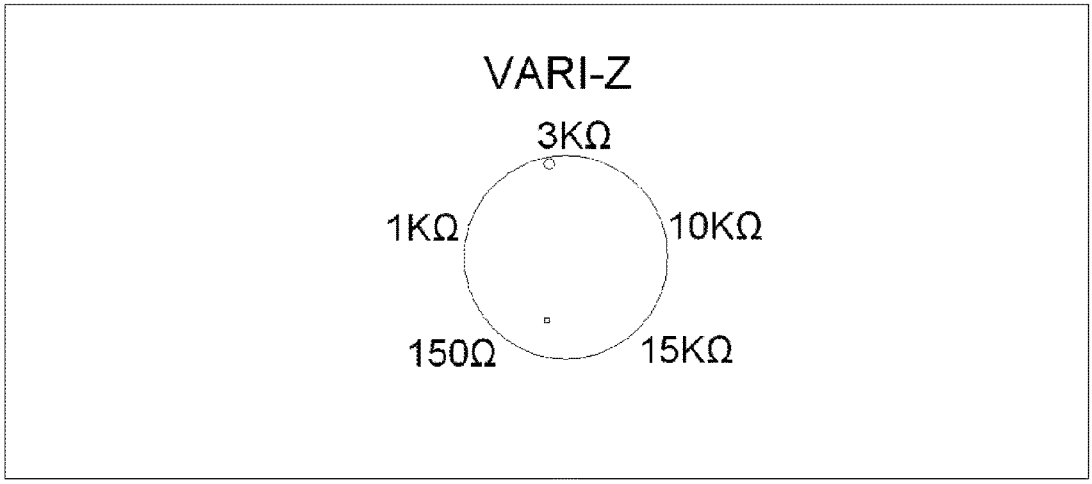
FIG. 3 shows a knob-based variable impedance loading adjustment interface, in accordance with an embodiment of the invention.

FIG. 3 shows a knob-based variable impedance loading adjustment interface called "VARI-Z" (300), in accordance with an embodiment of the invention. In general, variable impedance loading is related to resistive impedance-based variable loading effects, wherein one or more resistors and a potentiometer operatively connected to an adjustable interface (i.e. a knob) change resistive input impedance of the phantom-powered inline preamplifier. In this embodiment of the invention, the knob is configured to turn from a lowest impedance loading setting (i.e. 150 ohms) to a highest impedance loading setting (i.e. 15,000 ohms). The knob may be designed as a "sweeping" dial interface, in which the variable impedance loading adjustment can be continuously swept from the lowest impedance loading setting to the highest impedance loading setting. In another embodiment of the invention, the knob may simply be set to several preset positions along the knob's path of rotation (e.g. 150 ohms, 1,000 ohms, 3,000 ohms, 10,000 ohms, 15,000 ohms, and etc.).

Furthermore, the knob-based variable impedance loading adjustment interface called "VARI-Z" (300) may be on a surface of a phantom-powered inline preamplifier unit, or alternatively be located on a surface of an active microphone casing containing an integrated phantom-powered inline preamplifier.

Figure 4:
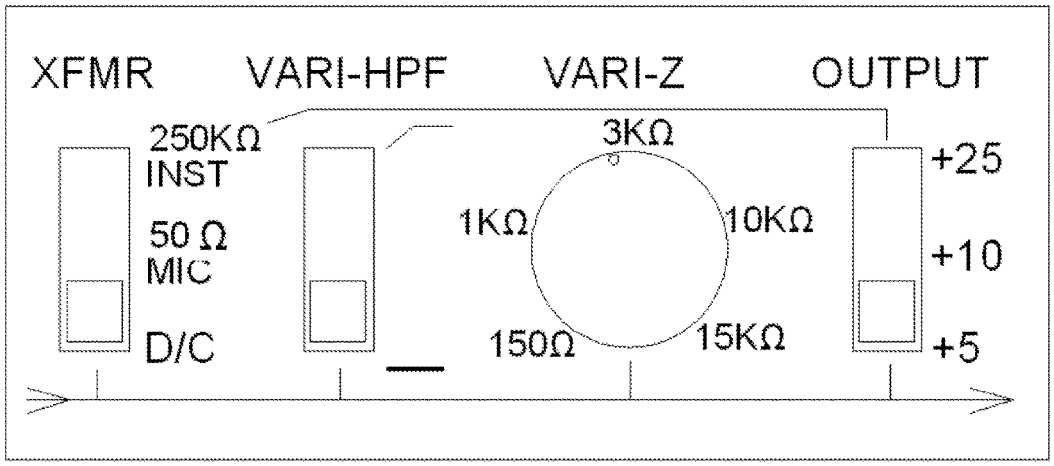
FIG. 4 shows a knob-based variable impedance loading adjustment interface with optional features such as a transformer impedance matching interface, a high-pass filter adjustment interface, and an output gain adjustment interface, in accordance with an embodiment of the invention.

FIG. 4 shows a knob-based variable impedance loading adjustment interface (VARI-Z) (400) with optional features such as a transformer impedance matching interface (XFMR), a high-pass filter adjustment interface (VARI-HPF), and an output gain adjustment interface (OUTPUT), in accordance with an embodiment of the invention.

Similar to FIG. 3, in this embodiment of the invention, the knob for variable impedance loading is configured to turn from a lowest impedance loading setting (i.e. 150 ohms) to a highest impedance loading setting (i.e. 15,000 ohms). The knob may be designed as a "sweeping" dial interface, in which the variable impedance loading adjustment can be continuously swept from the lowest impedance loading setting to the highest impedance loading setting. In another embodiment of the invention, the knob may simply be set to several preset positions along the knob's path of rotation (e.g. 150 ohms, 1,000 ohms, 3,000 ohms, 10,000 ohms, 15,000 ohms, and etc.).

In addition, in this embodiment of the invention, the transformer impedance matching interface (XFMR) has several modes of operation, including a direct-coupled (DC) mode, a 50 ohm microphone mode, and a 250 k-ohm instrument mode. If the phantom-powered inline preamplifier uses transformer impedance matching between the phantom-powered inline preamplifier and a microphone, then the transformer impedance matching interface (XFMR) enables adjustable impedance matching modes to accommodate the microphone's transformer impedance, or an instrument's transformer or inherent impedance with the phantom-powered inline preamplifier. Alternatively, the transformer impedance matching interface (XFMR) can simply provide a direct-coupling between the output of a sound source (e.g. a microphone, an instrument, and etc.) and the phantom-powered inline preamplifier, which may use resistive impedance instead of transformer impedance.

In addition, the high-pass filter adjustment interface (VARI-HPF) on the phantom-powered inline preamplifier may provide a bass-range reduction or cut (e.g. frequency reduction or cut below 40 Hz, 100 Hz, 300 Hz, and etc.), if the high-pass filter is enabled. Moreover, the output gain adjustment interface (OUTPUT) can provide a way to set a desired output signal gain value (e.g. 5 dB, 10, dB, 25 dB, and etc.) for an output terminal of the phantom-powered inline preamplifier.

Furthermore, the knob-based variable impedance loading adjustment interface (VARI-Z) (400) with optional features such as a transformer impedance matching interface (XFMR), a high-pass filter adjustment interface (VARI-HPF), and an output gain adjustment interface (OUTPUT) may be on a surface of a standalone phantom-powered inline preamplifier unit, or alternatively be located on a surface of an active microphone casing containing an integrated phantom-powered inline preamplifier.

Figure 5:
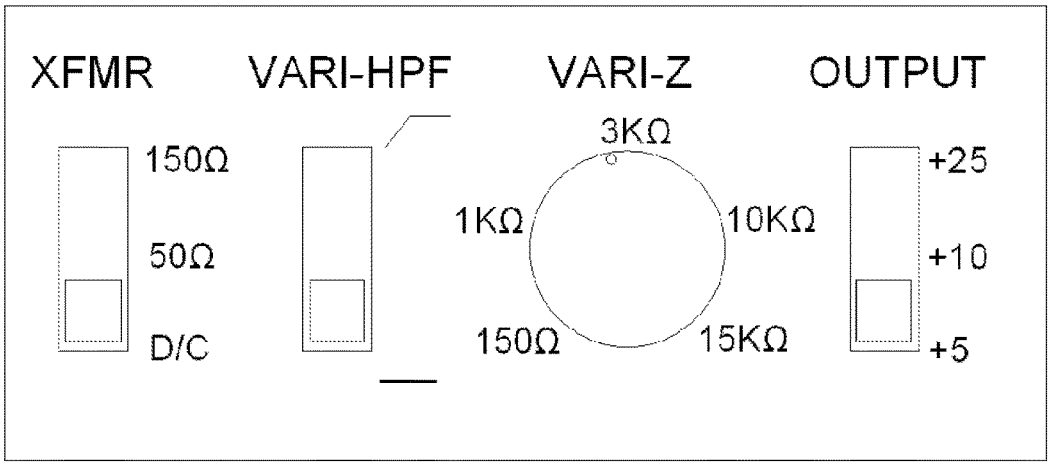
FIG. 5 shows another knob-based variable impedance loading adjustment interface with optional features such as a transformer impedance matching interface, a high-pass filter adjustment interface, and an output gain adjustment interface, in accordance with an embodiment of the invention.

FIG. 5 shows another knob-based variable impedance loading adjustment interface (VARI-Z) (500) with optional features such as a transformer impedance matching interface (XFMR), a high-pass filter adjustment interface (VARI-HPF), and an output gain adjustment interface (OUTPUT), in accordance with an embodiment of the invention.

Similar to FIG. 4, in this embodiment of the invention, the knob for variable impedance loading is configured to turn from a lowest impedance loading setting (i.e. 150 ohms) to a highest impedance loading setting (i.e. 15,000 ohms). The knob may be designed as a "sweeping" dial interface, in which the variable impedance loading adjustment can be continuously swept from the lowest impedance loading setting to the highest impedance loading setting. In another embodiment of the invention, the knob may simply be set to several preset positions along the knob's path of rotation (e.g. 150 ohms, 1,000 ohms, 3,000 ohms, 10,000 ohms, 15,000 ohms, and etc.).

In addition, in this embodiment of the invention, the transformer impedance matching interface (XFMR) has several modes of operation, including a direct-coupled (DC) mode, a 50 ohm microphone mode, and a 150 ohm mode. If the phantom-powered inline preamplifier uses transformer impedance matching between the phantom-powered inline preamplifier and a microphone, then the transformer impedance matching interface (XFMR) enables adjustable impedance matching modes to accommodate the microphone's transformer impedance, or an instrument's transformer or inherent impedance with the phantom-powered inline preamplifier. Alternatively, the transformer impedance matching interface (XFMR) can be bypassed by switching into a direct-coupling (DC) mode, allowing direct-coupling between the output of a sound source (e.g. a microphone, an instrument, and etc.) and the phantom-powered inline preamplifier, which may use resistive impedance (VARI-Z) instead of transformer impedance to provide the impedance control.

In addition, the high-pass filter adjustment interface (VARI-HPF) on the phantom-powered inline preamplifier may provide a bass-range reduction or cut (e.g. frequency reduction or cut below 40 Hz, 100 Hz, 300 Hz, and etc.), if the high-pass filter is enabled. Moreover, the output gain adjustment interface (OUTPUT) can provide a way to set a desired output signal gain value (e.g. 5 dB, 10, dB, 25 dB, and etc.) for an output terminal of the phantom-powered inline preamplifier.

Furthermore, the knob-based variable impedance loading adjustment interface (VARI-Z) (500) with optional features such as a transformer impedance matching interface (XFMR), a high-pass filter adjustment interface (VARI-HPF), and an output gain adjustment interface (OUTPUT) may be on a surface of a standalone phantom-powered inline preamplifier unit, or alternatively be located on a surface of an active microphone casing containing an integrated phantom-powered inline preamplifier.

Figure 6:
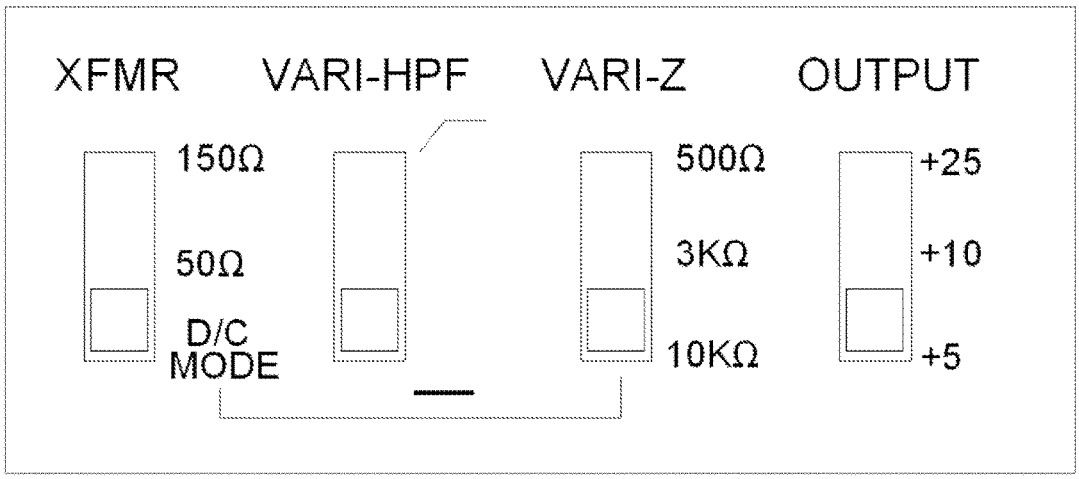
FIG. 6 shows a slider-based variable impedance loading adjustment interface with optional features such as a transformer impedance matching interface, a high-pass filter adjustment interface, and an output gain adjustment interface, in accordance with an embodiment of the invention.

FIG. 6 shows a slider-based variable impedance loading adjustment interface (VARI-Z) (600) with optional features such as a transformer impedance matching interface (XFMR), a high-pass filter adjustment interface (VARI-HPF), and an output gain adjustment interface (OUTPUT), in accordance with an embodiment of the invention. In D/C mode, the transformer is bypassed and impedance is controlled by the slider labeled "Vari-Z". This switches impedance adjustment from a transformer-based impedance matching to a D/C resistive method of adjusting the impedance (VARI-Z). Other than the fact that the variable impedance loading adjustment interface (VARI-Z) is a slider element, which can be set to specific positions (e.g. 10 k-ohms, 3 k-ohms, 500 ohms), adjustment interfaces and their features shown in FIG. 6 are very similar to those described for FIG. 5.

Figure 7:
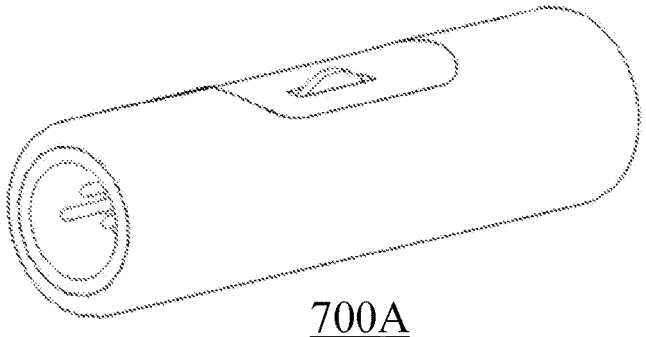
FIG. 7 shows several views of a cylindrical casing encapsulating a phantom-powered inline preamplifier and a roller-based variable impedance loading adjustment interface, in accordance with an embodiment of the invention.
Figure 7:
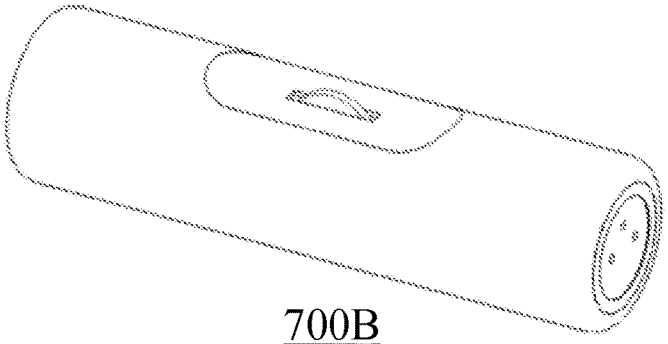
Figure 7:
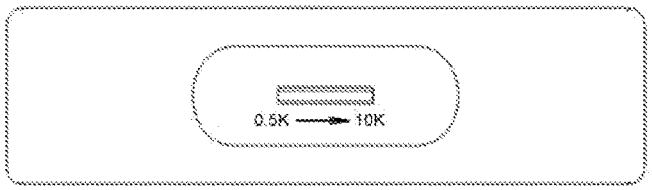
Figure 7:
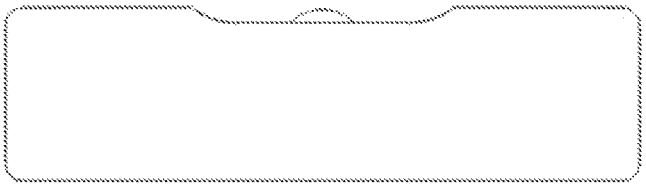

FIG. 7 shows several views (700A, 700B, 700C, 700D) of a cylindrical casing encapsulating a phantom-powered inline preamplifier and a roller-based variable impedance loading adjustment interface, in accordance with an embodiment of the invention. In this embodiment of the invention, variable impedance loading is related to resistive impedance-based variable loading effects, wherein one or more resistors and a potentiometer operatively connected to an adjustable interface (i.e. a roller) change resistive input impedance of the phantom-powered inline preamplifier inside the cylindrical casing.

In this embodiment of the invention, a roller on a surface of the cylindrical casing encapsulating the phantom-powered inline preamplifier is configured to rotate from a lowest impedance loading setting (i.e. 0.5 k-ohms) to a highest impedance loading setting (i.e. 10 k-ohms). The roller may be designed as a "sweeping" roller interface, in which the variable impedance loading adjustment can be continuously swept from the lowest impedance loading setting to the highest impedance loading setting. In another embodiment of the invention, the roller may simply be set to several preset positions along the roller's path of rotation (e.g. 0.5 k-ohms, 10 k-ohms, and etc.).

Figure 8:
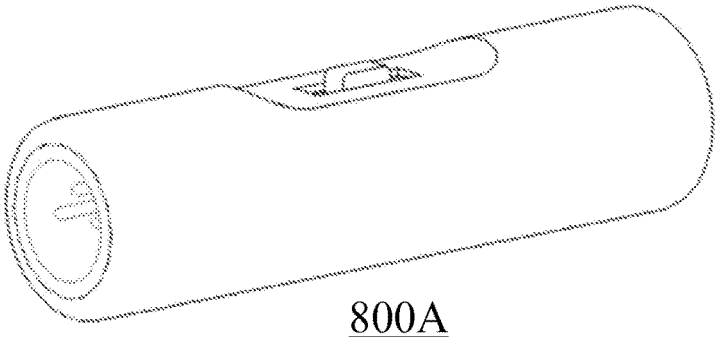
FIG. 8 shows several views of a cylindrical casing encapsulating a phantom-powered inline preamplifier and a slider-based variable impedance loading adjustment interface, in accordance with an embodiment of the invention.
Figure 8:
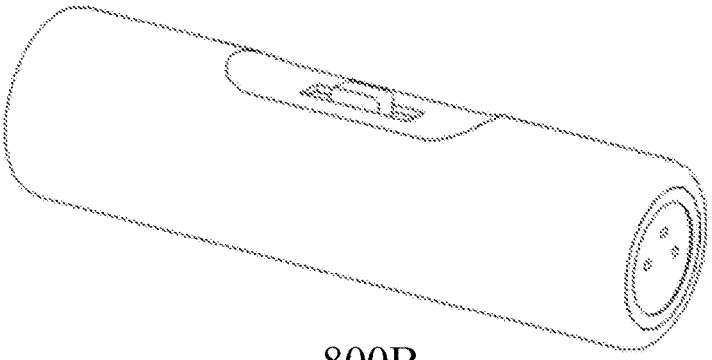
Figure 8:
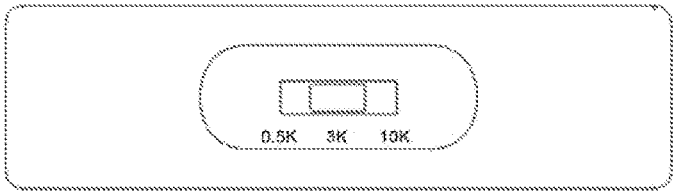
Figure 8:
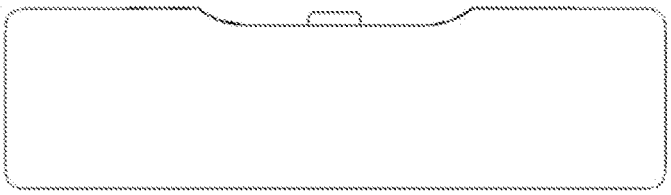

FIG. 8 shows several views (800A, 800B, 800C, 800D) of a cylindrical casing encapsulating a phantom-powered inline preamplifier and a slider-based variable impedance loading adjustment interface, in accordance with an embodiment of the invention. In this embodiment of the invention, variable impedance loading is related to resistive impedance-based variable loading effects, wherein one or more resistors and a potentiometer operatively connected to an adjustable interface (i.e. a slider) change resistive input impedance of the phantom-powered inline preamplifier inside the cylindrical casing In this embodiment of the invention, a slider on a surface of the cylindrical casing is configured to slide into a set position, including a lowest impedance loading setting (i.e. 0.5 k-ohms), a mid-range impedance setting (i.e. 3 k-ohms), a highest impedance loading setting (i.e. 10 k-ohms).

Figure 9:
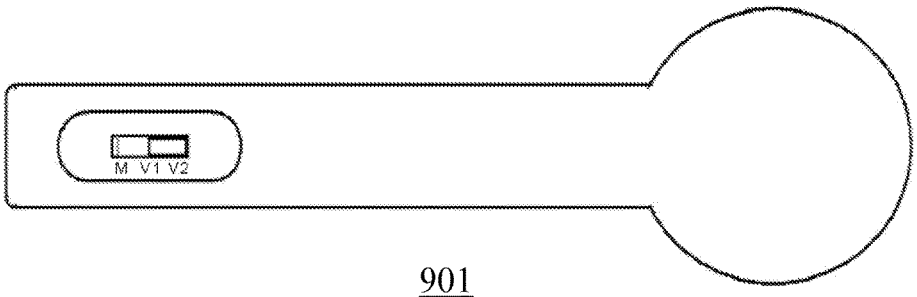
FIG. 9 shows three embodiments of an active microphone casing, each incorporating an internally-integrated phantom-powered preamplifier and a slider-based music or voice mode adjustment interface to achieve proximity effect response filtering.
Figure 9:
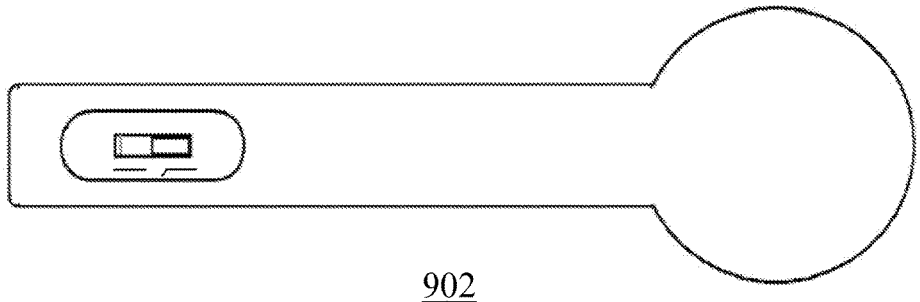
Figure 9:
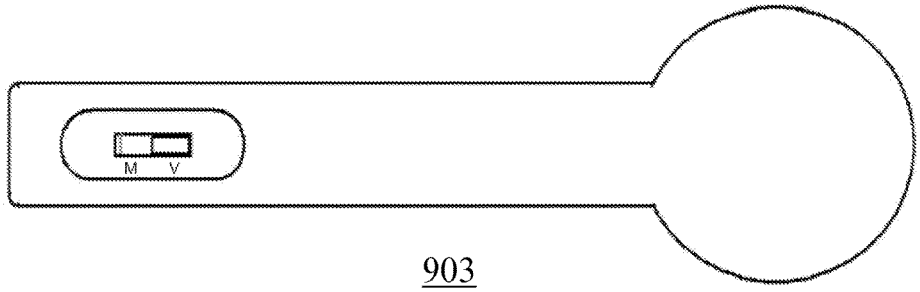

FIG. 9 shows three embodiments (901, 902, 903) of an active microphone casing, each incorporating an internally-integrated phantom-powered preamplifier and a slider-based music or voice mode adjustment interface to achieve proximity effect response filtering. Preferably, this active microphone casing contains a ribbon inside and provides functionality of a ribbon microphone in each of the three embodiments (901, 902, 903).

The first embodiment (901) as shown in FIG. 9 incorporates a slider on a surface of the active microphone casing. This slider is configured to slide into a music-mode position, shown as "M," a first voice-mode position, shown as "V1," or a second voice-mode position, shown as "V2," in the first embodiment (901). Preferably, the music-mode position ("M") provides an unaltered full frequency response without proximity effect-related filtering inside the active ribbon microphone casing. On the other hand, the first voice-mode position ("V1") provides a first magnitude of low frequency response filtering or reduction to reduce or eliminate undesirable accentuation of low frequency responses often caused by the proximity effect. Likewise, the second voice-mode position ("V2") provides a second magnitude of low frequency response filtering or reduction to reduce or eliminate undesirable accentuation of low frequency responses often caused by the proximity effect.

Although these voice modes (i.e. "V1," "V2," and etc.) are primarily designed to reduce proximity effect associated with a ribbon microphone, they can also be utilized if a user desires to create a certain magnitude of low frequency response filtering from the active microphone casing for an application that finds low frequency response filtering desirable. For example, the user may want to reduce bass or emphasize higher frequency ranges from the active microphone casing for a vocal performance, even if the singer is not necessarily situated overly close to the active microphone casing.

Preferably, the low frequency response filtering or reduction for each of the voice modes is provided by an integrated high-pass filter inside the active microphone casing. Furthermore, in one embodiment of the invention, the first magnitude of low frequency response filtering for the first voice-mode position ("V1") may be less than the second magnitude of low frequency response filtering for the second voice-mode position ("V2"). In an alternate embodiment of the invention, the first magnitude of low frequency response filtering for the first voice-mode position ("V1") may be more than the second magnitude of low frequency response filtering for the second voice-mode position ("V2").

Continuing with FIG. 9, the second embodiment (902) also incorporates a slider on a surface of the active microphone casing. This slider is configured to slide into a full frequency response position, shown as a flat line on the left side of the slider, or into a high pass filter position, shown on the right side of the slider, in the second embodiment (902). Preferably, the full frequency response position on the left side of the slider enables the user to engage the active microphone into an unaltered full frequency response without proximity effect-related filtering inside the active ribbon microphone casing.

On the other hand, the high pass filter position on the right side of the slider in the second embodiment (902) provides a low frequency response filtering or reduction to reduce or eliminate undesirable accentuation of low frequency responses often caused by the proximity effect. Even though the high pass filter position in the second embodiment (902) is primarily designed to reduce proximity effect associated with a ribbon microphone, this position in the second embodiment (902) can also be utilized whenever a user desires to create a certain magnitude of low frequency response filtering from the active microphone casing for an application that finds low frequency response filtering desirable.

Continuing with FIG. 9, the third embodiment (903) also incorporates a slider on a surface of the active microphone casing. This slider is configured to slide into a music-mode position, shown as "M," or a voice-mode position, shown as "V." In this embodiment, the music-mode position ("M") provides an unaltered full frequency response without proximity effect-related filtering inside the active ribbon microphone casing. On the other hand, the voice-mode position ("V") provides a preset level of low frequency response filtering or reduction to reduce or eliminate undesirable accentuation of low frequency responses often caused by the proximity effect.

Although the voice mode ("V") is primarily designed to reduce proximity effect associated with a ribbon microphone, it can also be utilized if a user desires to create a certain magnitude of low frequency response filtering from the active microphone casing for an application that finds low frequency response filtering desirable. Preferably, the low frequency response filtering or reduction for the voice mode is provided by an integrated high-pass filter inside the active microphone casing.

Figure 10:
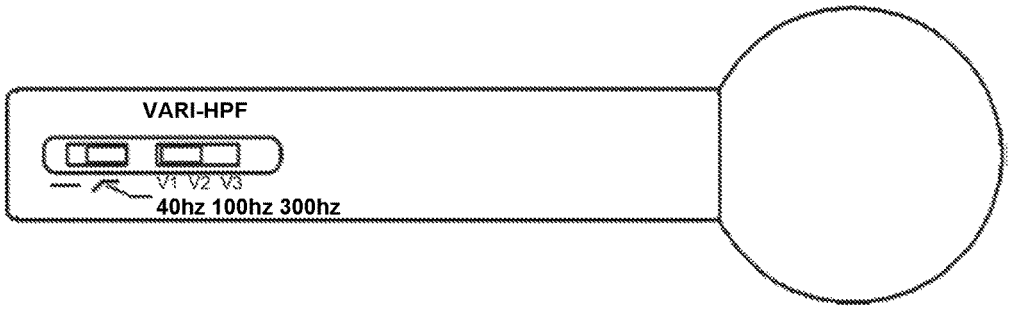
FIG. 10 shows three embodiments of another active microphone casing, each incorporating a phantom-powered inline preamplifier, a slider-based voice-mode adjustment interface, and a slider-based music or voice mode adjustment interface to achieve proximity effect response filtering.
Figure 10:
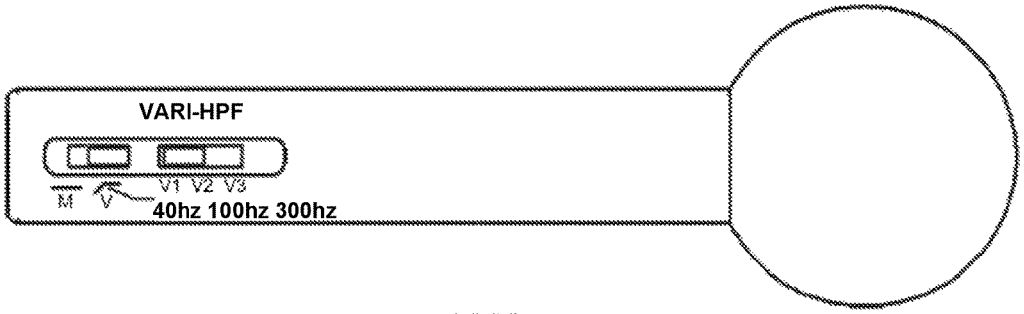
Figure 10:
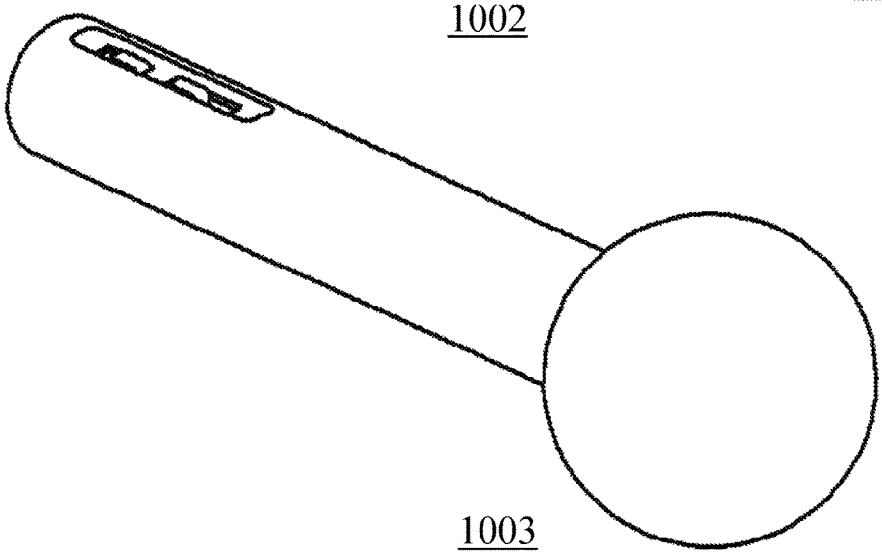

FIG. 10 shows three embodiments (1001, 1002, 1003) of another active microphone casing, each incorporating a phantom-powered inline preamplifier, a slider-based full frequency response vs. low frequency response and high pass filtering adjustment interface, and a slider-based variable voice mode adjustment interface to achieve proximity effect response filtering. In each of these three embodiments (1001, 1002, 1003) of the invention, a left-side slider is the slider-based full frequency response vs. low frequency response and high pass filtering adjustment interface. Moreover, a right-side slider is the slider-based variable voice mode adjustment interface, which achieves various levels of bass reduction and proximity effect response filtering.

In the first embodiment (1001) of FIG. 10, the left-side slider has a full frequency response position, shown with a "flat line" label. The "flat line" label provides the full frequency response position, and disables a variable high-pass filter associated with various voice mode adjustments (i.e. "V1," "V2," "V3") controlled by the right-side slider. The left-side slider also has a high pass filter-enable position, shown with an upward trajectory as a label on the left-side slider in the first embodiment (1001). If the left-side slider is slid into the high pass filter-enable position, then the right-side slider is enabled to provide various voice mode adjustment positions ("V1," "V2," "V3"). For the first embodiment (1001) of FIG. 10, "V1" position has a high pass filter cutoff value of 40 Hz, which indicates that low frequencies approximately at 40 Hz or below will have reduced frequency response (e.g. bass cut) relative to the frequency range above 40 Hz. Likewise, "V2" position has a high pass filter cutoff value of 100 Hz, which indicates that low frequencies approximately at 100 Hz or below will have reduced frequency response (e.g. bass cut) relative to the frequency range above 100 Hz. Similarly, "V3" position has a high pass filter cutoff value of 300 Hz, which indicates that low frequencies approximately at 300 Hz or below will have reduced frequency response (e.g. bass cut) relative to the frequency range above 300 Hz.

In the first embodiment (1001) of FIG. 10, the "V1" position provides the least aggressive bass cutoff, compared to the "V2" and the "V3" positions, because the "V1" position will only reduce very low bass frequency at 40 Hz or below, while still passing low frequencies above 40 Hz. On the other hand, the "V2" position cuts the bass frequency more aggressively by reducing the bass frequencies up to 100 Hz. Furthermore, the "V3" position provides the most aggressive bass cutoff by reducing the bass frequencies up to 300 Hz. Therefore, a user can think of the various voice mode adjustment positions to be ordered from the least (i.e. "V1") to the most (i.e. "V3") aggressive bass reduction modes, as shown in the first embodiment (1001). In an alternate embodiment of the invention, the various voice mode adjustment positions may instead be ordered from the most to the least aggressive bass reduction modes.

Continuing with FIG. 10, in the second embodiment (1002) of FIG. 10, the left-side slider has a music position, shown with the letter "M" and a flat line as its label. Preferably, the music position is a full frequency position, and disables a variable high-pass filter associated with various voice mode adjustments (i.e. "V1," "V2," "V3") controlled by the right-side slider. The left-side slider also has a voice position, shown with the letter "V" and an upward trajectory as its label on the left-side slider in the second embodiment (1002). Preferably, the voice position is a high pass filter-enable position, which enables the right-side slider to provide various voice mode adjustment positions ("V1," "V2," "V3").

For the second embodiment (1002) of FIG. 10, "V1" position has a high pass filter cutoff value of 40 Hz, which indicates that low frequencies approximately at 40 Hz or below will have reduced frequency response (e.g. bass cut) relative to the frequency range above 40 Hz. Likewise, "V2" position has a high pass filter cutoff value of 100 Hz, which indicates that low frequencies approximately at 100 Hz or below will have reduced frequency response (e.g. bass cut) relative to the frequency range above 100 Hz. Similarly, "V3" position has a high pass filter cutoff value of 300 Hz, which indicates that low frequencies approximately at 300 Hz or below will have reduced frequency response (e.g. bass cut) relative to the frequency range above 300 Hz.

In the second embodiment (1002) of FIG. 10, the "V1" position provides the least aggressive bass cutoff, compared to the "V2" and the "V3" positions, because the "V1" position will only reduce very low bass frequency at 40 Hz or below, while still passing low frequencies above 40 Hz. On the other hand, the "V2" position cuts the bass frequency more aggressively by reducing the bass frequencies up to 100 Hz. Furthermore, the "V3" position provides the most aggressive bass cutoff by reducing the bass frequencies up to 300 Hz. Therefore, a user can think of the various voice mode adjustment positions to be ordered from the least (i.e. "V1") to the most (i.e. "V3") aggressive bass reduction modes, as shown in the second embodiment (1002). In an alternate embodiment of the invention, the various voice mode adjustment positions may instead be ordered from the most to the least aggressive bass reduction modes.

The third embodiment (1003) of FIG. 10 shows a side perspective view of an active microphone casing, each incorporating a phantom-powered inline preamplifier, a slider-based full frequency response vs. low frequency response and high pass filtering adjustment interface, and a slider-based variable voice mode adjustment interface to achieve proximity effect response filtering. As shown and described in the first embodiment (1001) and the second embodiment (1002) of FIG. 10, one of the two sliders enable switching between the music position vs. the voice position (i.e. the full frequency position vs. the high-pass filter enable position), while the other slider provides various voice mode adjustment positions (i.e. varying levels of bass cutoff, such as "V1," "V2," and "V3").

Figure 11:
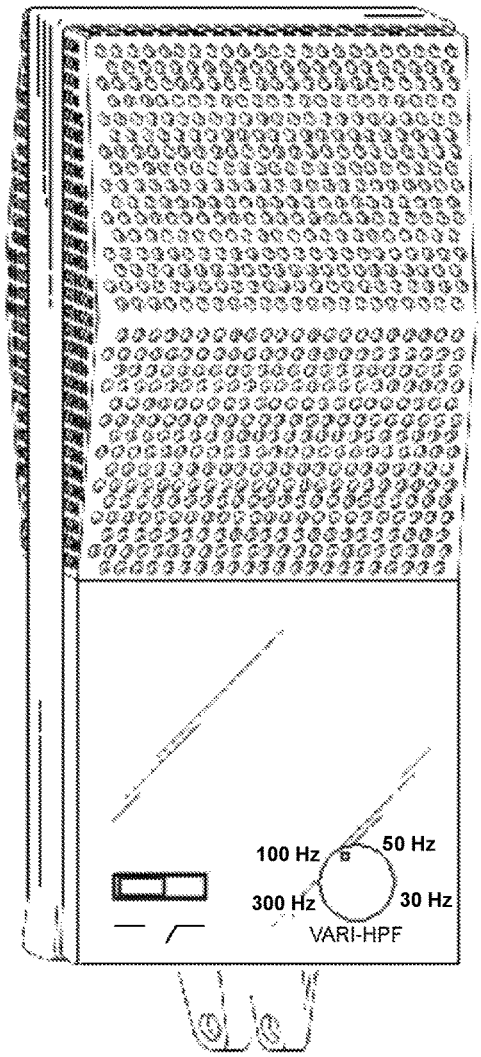
FIG. 11 shows two embodiments of an active ribbon microphone casing, each incorporating a phantom-powered inline preamplifier, a knob-based variable voice mode adjustment interface, and a slider-based music or voice mode adjustment interface to achieve proximity effect response filtering.
Figure 11:
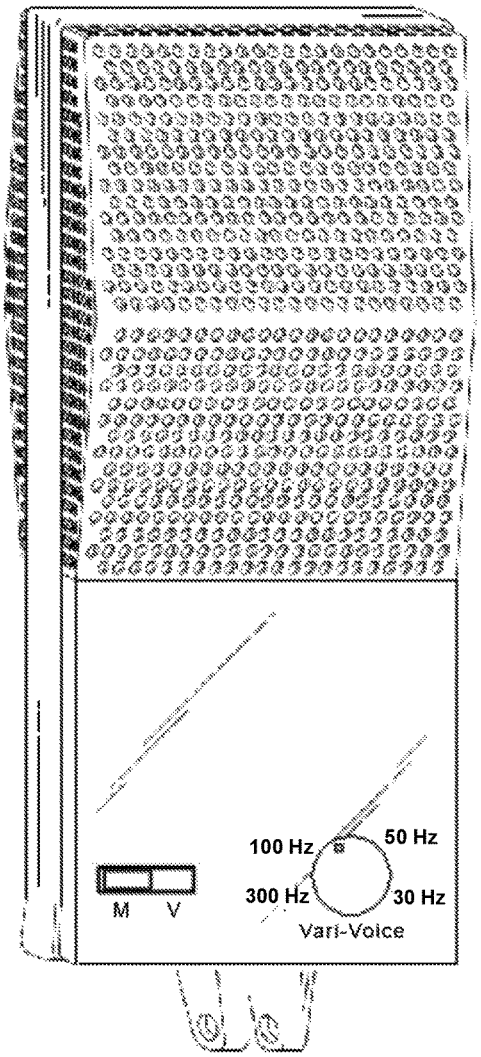

FIG. 11 shows two embodiments (1101, 1102) of an active ribbon microphone casing, each incorporating a phantom-powered inline preamplifier, a knob-based variable voice mode adjustment interface, and a slider-based music or voice mode adjustment interface to achieve proximity effect response filtering. In each of these embodiments (1101, 1102) of the invention, a left-side slider is the slider-based full frequency response vs. low frequency response and high pass filtering adjustment interface. Moreover, a right-side knob is the knob-based variable voice mode adjustment interface, which achieves various levels of bass reduction and proximity effect response filtering.

In the first embodiment (1101) of FIG. 11, the left-side slider has a full frequency response position, shown with a "flat line" label. The "flat line" label provides the full frequency response position, and disables a variable high-pass filter associated with various voice mode adjustments (i.e. "300 Hz," "100 Hz," "50 Hz," and "30 Hz") controlled by the right-side knob. The left-side slider also has a high pass filter-enable position, shown with an upward trajectory as a label on the left-side slider in the first embodiment (1101). If the left-side slider is slid into the high pass filter-enable position, then the right-side knob is enabled to provide various voice mode adjustment positions (i.e. "300 Hz," "100 Hz," "50 Hz," and "30 Hz") around the rotating axis of the right-side knob. For the first embodiment (1101) of FIG. 11, "30 Hz" position on the right-side knob has a high pass filter cutoff value of 30 Hz, which indicates that low frequencies approximately at 30 Hz or below will have reduced frequency response (e.g. bass cut) relative to the frequency range above 30 Hz. Similarly, "50 Hz" position on the right-side knob has a high pass filter cutoff value of 50 Hz, thereby reducing the frequency response of the microphone on bass frequencies at 50 Hz or below. Likewise, "100 Hz" position has a high pass filter cutoff value of 100 Hz, which indicates that low frequencies approximately at 100 Hz or below will have reduced frequency response (e.g. bass cut) relative to the frequency range above 100 Hz. Furthermore, "300 Hz" position has a high pass filter cutoff value of 300 Hz, which indicates that low frequencies approximately at 300 Hz or below will have reduced frequency response (e.g. bass cut) relative to the frequency range above 300 Hz.

In the first embodiment (1101) of FIG. 11, the "30 Hz" position provides the least aggressive bass cutoff, compared to the other three positions, because the "30 Hz" position will only reduce very low bass frequency at 30 Hz or below, while still passing low frequencies above 30 Hz. On the other hand, the other three positions for "50 Hz," "100 Hz," and "300 Hz" voice adjustment mode positions will provide more aggressive bass frequency reductions, respectively in that order, because the bass frequency cutoff point is progressively raised in each position from 50 Hz to 300 Hz. In one example, a singer situated close to the active ribbon microphone can offset or reduce proximity effect of the active ribbon microphone by selecting a desirable voice adjustment (i.e. bass cutoff or reduction) mode in accordance with the singer's tonal preferences.

Continuing with FIG. 11, in the second embodiment (1102) of FIG. 11, the left-side slider has a music position, shown with the letter "M" as its label. Preferably, the music position is a full frequency position, and disables a variable high-pass filter associated with various voice mode adjustments (i.e. "300 Hz," "100 Hz," "50 Hz," and "30 Hz") controlled by the right-side knob. The left-side slider also has a voice position, shown with the letter "V" as its label on the left-side slider in the second embodiment (1102). Preferably, the voice position is a high pass filter-enable position, which enables the right-side slider to provide various voice mode adjustment positions (i.e. "300 Hz," "100 Hz," "50 Hz," and "30 Hz").

For the second embodiment (1102) of FIG. 11, "30 Hz" position on the right-side knob has a high pass filter cutoff value of 30 Hz, which indicates that low frequencies approximately at 30 Hz or below will have reduced frequency response (e.g. bass cut) relative to the frequency range above 30 Hz. Similarly, "50 Hz" position on the right-side knob has a high pass filter cutoff value of 50 Hz, thereby reducing the frequency response of the microphone on bass frequencies at 50 Hz or below. Likewise, "100 Hz" position has a high pass filter cutoff value of 100 Hz, which indicates that low frequencies approximately at 100 Hz or below will have reduced frequency response (e.g. bass cut) relative to the frequency range above 100 Hz. Furthermore, "300 Hz" position has a high pass filter cutoff value of 300 Hz, which indicates that low frequencies approximately at 300 Hz or below will have reduced frequency response (e.g. bass cut) relative to the frequency range above 300 Hz.

In the second embodiment (1102) of FIG. 11, the "30 Hz" position provides the least aggressive bass cutoff, compared to the other three positions, because the "30 Hz" position will only reduce very low bass frequency at 30 Hz or below, while still passing low frequencies above 30 Hz. On the other hand, the other three positions for "50 Hz," "100 Hz," and "300 Hz" voice adjustment mode positions will provide more aggressive bass frequency reductions, respectively in that order, because the bass frequency cutoff point is progressively raised in each position from 50 Hz to 300 Hz. In one example, a singer situated close to the active ribbon microphone can offset or reduce proximity effect of the active ribbon microphone by selecting a desirable voice adjustment (i.e. bass cutoff or reduction) mode in accordance with the singer's tonal preferences.

Figure 12:
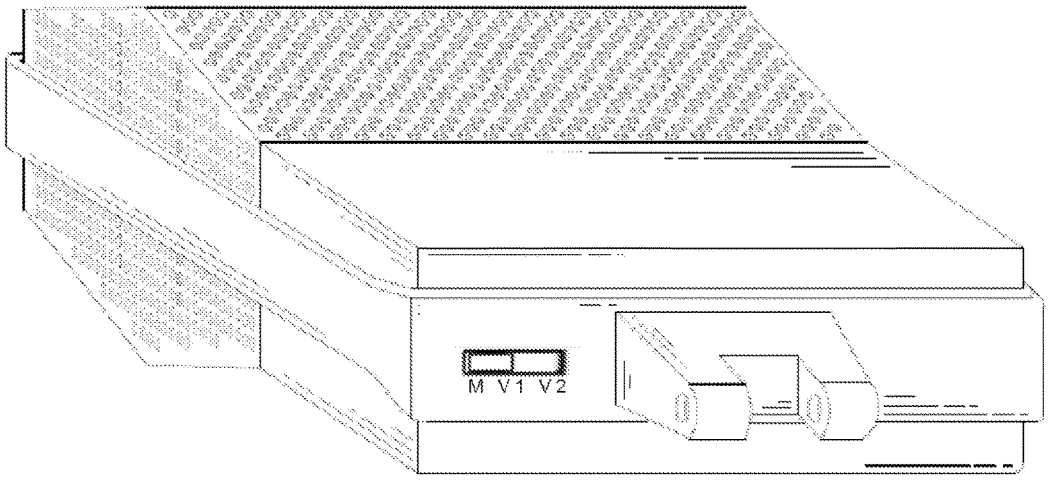
FIG. 12 shows two embodiments of another active ribbon microphone casing, each incorporating a phantom-powered inline preamplifier and a slider-based music or voice mode adjustment interface to achieve proximity effect response filtering.
Figure 12:
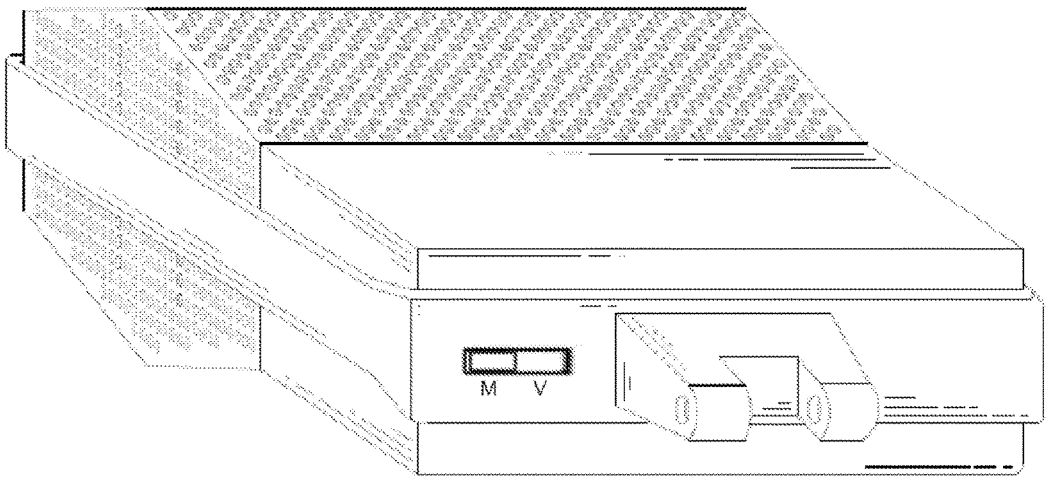

FIG. 12 shows two embodiments (1201, 1202) of another active ribbon microphone casing, each incorporating a phantom-powered inline preamplifier and a slider-based music or voice mode adjustment interface to achieve proximity effect response filtering. In the first embodiment (1201) of FIG. 12, an active ribbon microphone casing incorporates a slider on a bottom surface of the active ribbon microphone casing. This slider on the bottom surface of the active ribbon microphone casing is configured to slide into a music-mode position, shown as "M," a first voice-mode position, shown as "V1," or a second voice-mode position, shown as "V2," in the first embodiment (1201). Preferably, the music-mode position ("M") provides an unaltered full frequency response without proximity effect-related filtering inside the active ribbon microphone casing. On the other hand, the first voice-mode position ("V1") provides a first magnitude of low frequency response filtering or reduction to reduce or eliminate undesirable accentuation of low frequency responses often caused by the proximity effect. Likewise, the second voice-mode position ("V2") provides a second magnitude of low frequency response filtering or reduction to reduce or eliminate undesirable accentuation of low frequency responses often caused by the proximity effect.

Although these voice modes (i.e. "V1," "V2," and etc.) are primarily designed to reduce proximity effect associated with a ribbon microphone, they can also be utilized if a user desires to create a certain magnitude of low frequency response filtering from the active ribbon microphone casing for an application that finds low frequency response filtering desirable. For example, the user may want to reduce bass or emphasize higher frequency ranges from the active ribbon microphone casing for a vocal performance, even if the singer is not necessarily situated overly close to the active ribbon microphone casing.

Preferably, the low frequency response filtering or reduction for each of the voice modes is provided by an integrated high-pass filter inside the active ribbon microphone casing. Furthermore, in one embodiment of the invention, the first magnitude of low frequency response filtering for the first voice-mode position ("V1") may be less than the second magnitude of low frequency response filtering for the second voice-mode position ("V2"). In an alternate embodiment of the invention, the first magnitude of low frequency response filtering for the first voice-mode position ("V1") may be more than the second magnitude of low frequency response filtering for the second voice-mode position ("V2").

Continuing with FIG. 12, the second embodiment (1202) also incorporates a slider on a bottom surface of an active ribbon microphone casing. This slider is configured to slide into a music-mode position, shown as "M," or a voice-mode position, shown as "V." In this embodiment, the music-mode position ("M") provides an unaltered full frequency response without proximity effect-related filtering inside the active ribbon microphone casing. On the other hand, the voice-mode position ("V") provides a preset level of low frequency response filtering or reduction to reduce or eliminate undesirable accentuation of low frequency responses often caused by the proximity effect.

Although the voice mode ("V") is primarily designed to reduce proximity effect associated with a ribbon microphone, it can also be utilized if a user desires to create a certain magnitude of low frequency response filtering from the active ribbon microphone casing for an application that finds low frequency response filtering desirable. Preferably, the low frequency response filtering or reduction for the voice mode is provided by an integrated high-pass filter inside the active ribbon microphone casing.

Figure 13:
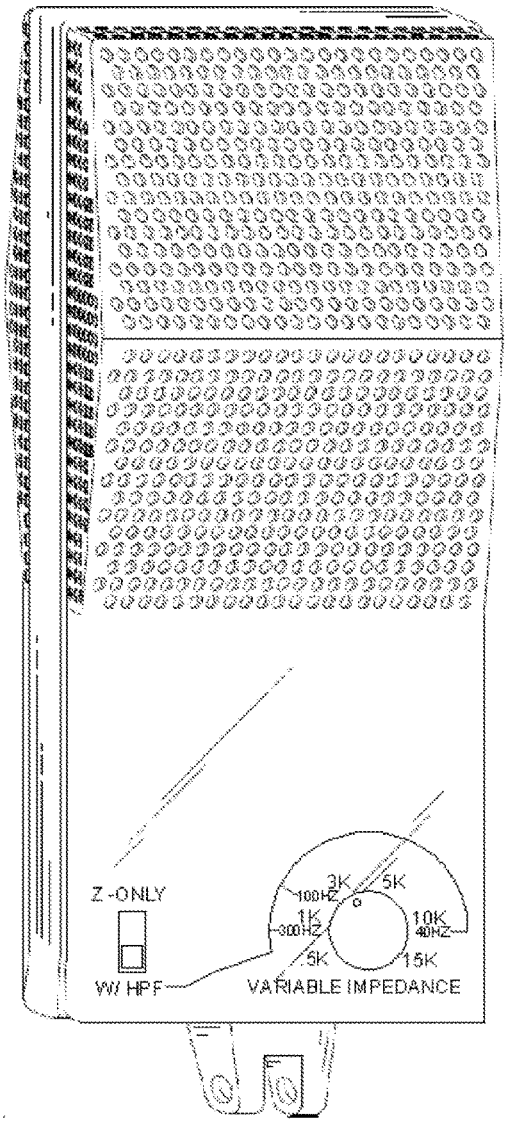
FIG. 13 shows several views of an active ribbon microphone casing which incorporates a phantom-powered inline preamplifier, a knob-based variable impedance loading adjustment interface, and a high-pass filter adjustment interface, in accordance with an embodiment of the invention.
Figure 13:
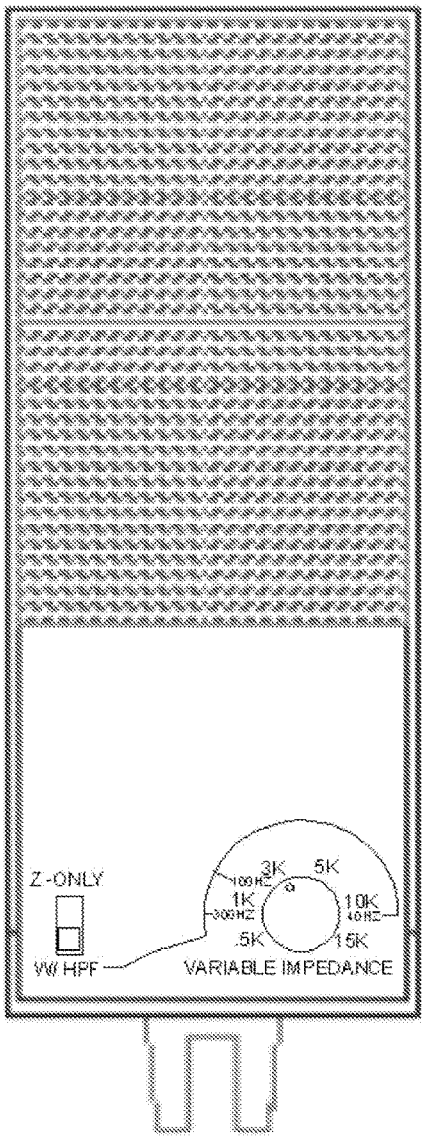

FIG. 13 shows several views (1300A, 1300B) of an active ribbon microphone casing which incorporates a phantom-powered inline preamplifier, a knob-based variable impedance loading adjustment interface, and a high-pass filter adjustment interface, in accordance with an embodiment of the invention. In this embodiment of the invention, variable impedance loading is related to resistive impedance-based variable loading effects, wherein one or more resistors and a potentiometer operatively connected to an adjustable interface (i.e. a knob) change resistive input impedance of the integrated phantom-powered inline preamplifier inside the active ribbon microphone casing.

In this embodiment of the invention, the knob on a surface of the active ribbon microphone casing is configured to rotate from a lowest impedance loading setting (i.e. 0.5 k-ohms) to a highest impedance loading setting (i.e. 15 k-ohms). The knob may be designed as a "sweeping" dial interface, in which the variable impedance loading adjustment can be continuously swept from the lowest impedance loading setting to the highest impedance loading setting. In another embodiment of the invention, the knob may simply be set to several preset positions along the knob's path of rotation (e.g. 0.5 k-ohms, 1 k-ohms, 3 k-ohms, 5 k-ohms, 10 k-ohms, 15 k-ohms, and etc.).

Furthermore, in the embodiment of the invention as shown in FIG. 13, a slider for variable high-pass filter on the surface of the active ribbon microphone casing is configured to slide to multiple positions (e.g. impedance (Z)-only mode, HPF enable mode (W/ HPF), HPF adjustment for cutoff values of 40 Hz, 100 Hz, 300 Hz, and etc.) to adjust values of the variable high-pass filter. In this embodiment of the invention, the slider used as a high-pass filter adjustment interface on the active ribbon microphone with the integrated phantom-powered inline preamplifier may provide a bass-range reduction or cut (e.g. frequency reduction or cut below 40 Hz, 100 Hz, 300 Hz), if the high-pass filter is enabled.

In one embodiment of the invention, changing an impedance loading value (e.g. 1 k-ohms, 3 k-ohms, 10 k-ohms, and etc.) also impacts the cutoff values for the high pass filter. For example, setting the variable impedance loading value to 1 k-ohms may have an effect on the high pass filter to make its cutoff value be somewhere around 300 Hz, if the high pass filter is turned on. Likewise, setting the variable impedance loading value to 10 k-ohms may have an effect on the high pass filter to make its cutoff value be somewhere around 40 Hz, if the high pass filter is turned on.

Figure 14:
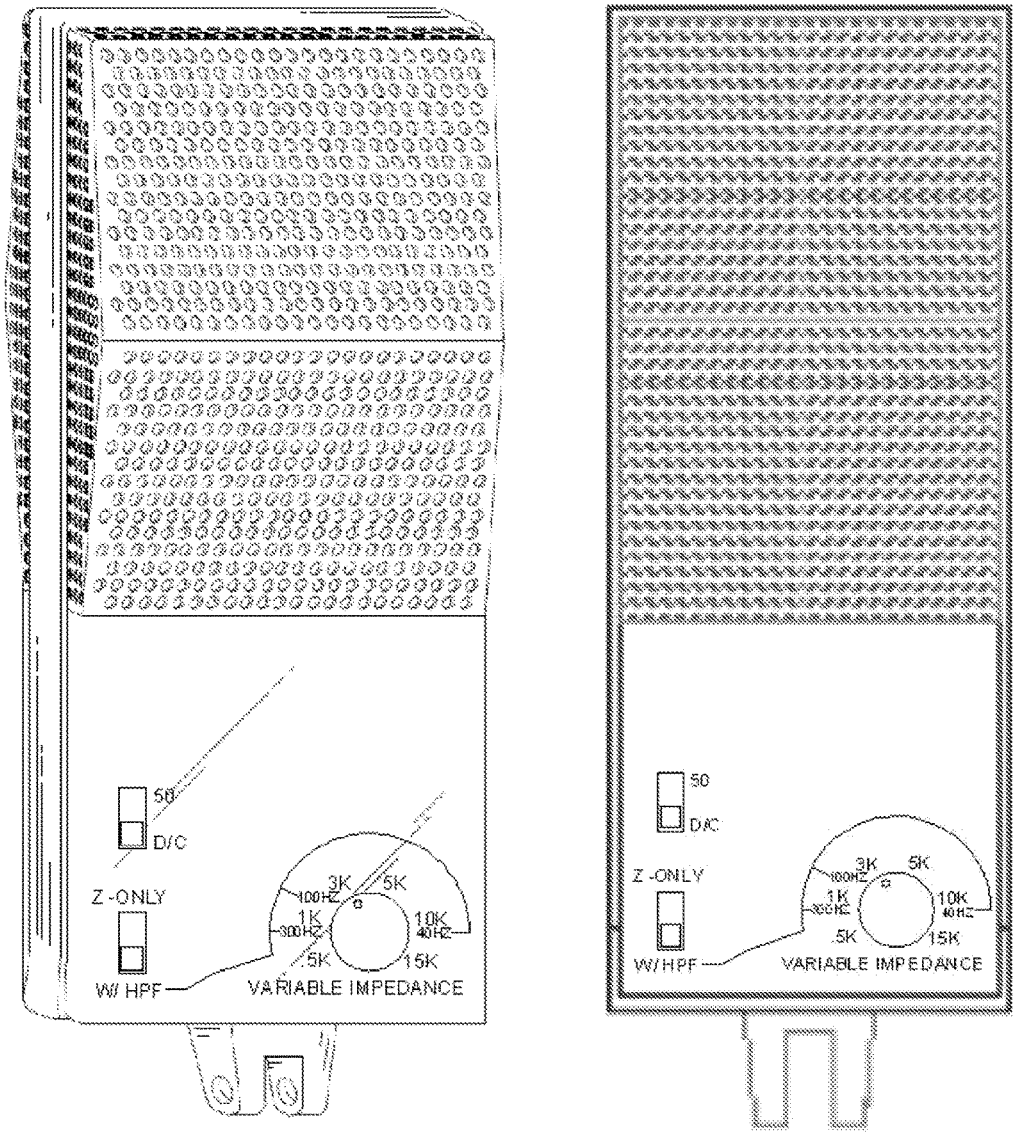
FIG. 14 shows several views of an active ribbon microphone casing which incorporates a phantom-powered inline preamplifier, a knob-based variable impedance loading adjustment interface, a high-pass filter adjustment interface, and a transformer impedance matching interface, in accordance with an embodiment of the invention.

FIG. 14 shows several views (1400A, 1400B) of an active ribbon microphone casing which incorporates a phantom-powered inline preamplifier, a knob-based variable impedance loading adjustment interface, a high-pass filter adjustment interface, and a transformer impedance matching interface, in accordance with an embodiment of the invention. In this embodiment of the invention, variable impedance loading is related to resistive impedance-based variable loading effects, wherein one or more resistors and a potentiometer operatively connected to an adjustable interface (i.e. a knob) change resistive input impedance of the integrated phantom-powered inline preamplifier inside the active ribbon microphone casing.

In this embodiment of the invention, the knob on a surface of the active ribbon microphone casing is configured to rotate from a lowest impedance loading setting (i.e. 0.5 k-ohms) to a highest impedance loading setting (i.e. 15 k-ohms). The knob may be designed as a "sweeping" dial interface, in which the variable impedance loading adjustment can be continuously swept from the lowest impedance loading setting to the highest impedance loading setting. In another embodiment of the invention, the knob may simply be set to several preset positions along the knob's path of rotation (e.g. 0.5 k-ohms, 1 k-ohms, 3 k-ohms, 5 k-ohms, 10 k-ohms, 15 k-ohms, and etc.).

Furthermore, in the embodiment of the invention as shown in FIG. 14, a slider for variable high-pass filter on the surface of the active ribbon microphone casing is configured to slide to multiple positions (e.g. impedance (Z)-only mode, HPF enable mode (W/ HPF), HPF adjustment for cutoff values of 40 Hz, 100 Hz, 300 Hz, and etc.) to adjust values of the variable high-pass filter. In this embodiment of the invention, the slider used as a high-pass filter adjustment interface on the active ribbon microphone with the integrated phantom-powered inline preamplifier may provide a bass-range reduction or cut (e.g. frequency reduction or cut below 40 Hz, 100 Hz, or 300 Hz), if the high-pass filter is enabled.

In one embodiment of the invention, changing an impedance loading value (e.g. 1 k-ohms, 3 k-ohms, 10 k-ohms, and etc.) also impacts the cutoff values for the high pass filter. For example, setting the variable impedance loading value to 1 k-ohms may have an effect on the high pass filter to make its cutoff value be somewhere around 300 Hz, if the high pass filter is turned on. Likewise, setting the variable impedance loading value to 10 k-ohms may have an effect on the high pass filter to make its cutoff value be somewhere around 40 Hz, if the high pass filter is turned on.

In addition, the active ribbon microphone casing as shown in FIG. 14 also has a transformer impedance matching interface with several modes of operation, including a direct-coupled (DC) mode, and a 50 ohm transformer-coupled mode. This provides the user a choice between a transformer-based impedance matching (50 ohm transformer impedance matching) and a direct coupling (DC) to the integrated inline phantom-powered preamplifier to allow resistive impedance matching. Providing this selectivity between the two modes may be useful because the sound characteristics are influenced by the transformer, which can be desirable in some applications. By having a D/C mode which enables resistive impedance adjustments using the variable impedance interface (i.e. instead of transformer-based impedance matching), various embodiments of the present invention, including an embodiment shown in FIG. 14, provides flexible impedance adjustment options.

Figure 15:
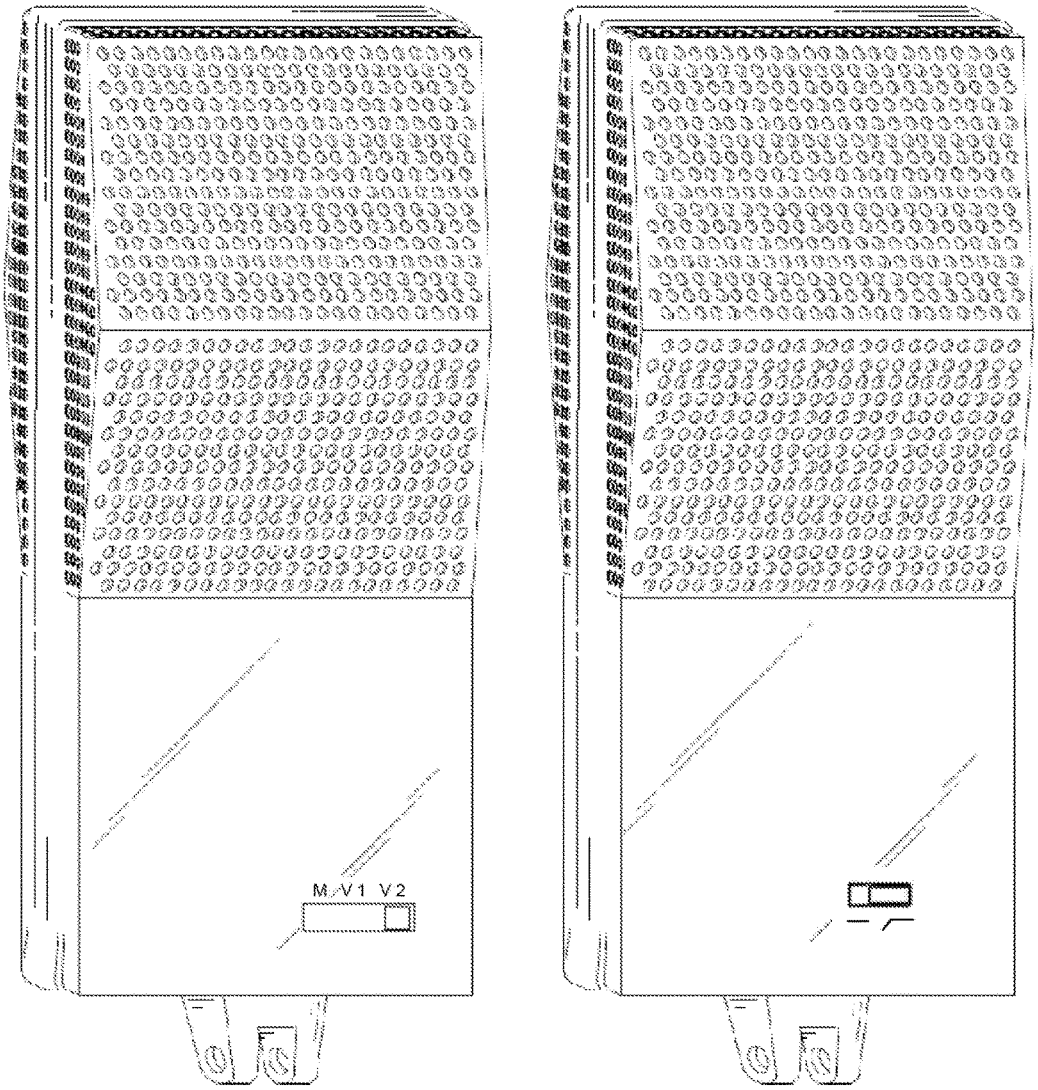
FIG. 15 shows two embodiments of an active ribbon microphone casing, each incorporating a phantom-powered inline preamplifier and a slider-based music or voice mode adjustment interface to achieve proximity effect response filtering.

FIG. 15 shows two embodiments (1501, 1502) of an active ribbon microphone casing, each incorporating a phantom-powered inline preamplifier and a slider-based music or voice mode adjustment interface to achieve proximity effect response filtering. In the first embodiment (1501) of the active ribbon microphone casing, a slider is incorporated on a frontal surface of the active ribbon microphone casing. This slider on the frontal surface of the active ribbon microphone casing is configured to slide into a music-mode position, shown as "M," a first voice-mode position, shown as "V1," or a second voice-mode position, shown as "V2," in the first embodiment (1501). Preferably, the music-mode position ("M") provides an unaltered full frequency response without proximity effect-related filtering inside the active ribbon microphone casing. On the other hand, the first voice-mode position ("V1") provides a first magnitude of low frequency response filtering or reduction to reduce or eliminate undesirable accentuation of low frequency responses often caused by the proximity effect. Likewise, the second voice-mode position ("V2") provides a second magnitude of low frequency response filtering or reduction to reduce or eliminate undesirable accentuation of low frequency responses often caused by the proximity effect.

Although these voice modes (i.e. "V1," "V2," and etc.) are primarily designed to reduce proximity effect associated with a ribbon microphone, they can also be utilized if a user desires to create a certain magnitude of low frequency response filtering from the active ribbon microphone casing for an application that finds low frequency response filtering desirable. For example, the user may want to reduce bass or emphasize higher frequency ranges from the active ribbon microphone casing for a vocal performance, even if the singer is not necessarily situated overly close to the active ribbon microphone casing.

Preferably, the low frequency response filtering or reduction for each of the voice modes is provided by an integrated high-pass filter inside the active ribbon microphone casing. Furthermore, in one embodiment of the invention, the first magnitude of low frequency response filtering for the first voice-mode position ("V1") may be less than the second magnitude of low frequency response filtering for the second voice-mode position ("V2"). In an alternate embodiment of the invention, the first magnitude of low frequency response filtering for the first voice-mode position ("V1") may be more than the second magnitude of low frequency response filtering for the second voice-mode position ("V2").

Continuing with FIG. 15, the second embodiment (1502) of the active ribbon microphone casing also incorporates a slider on a frontal surface of the active microphone casing. This slider is configured to slide into a full frequency response position, shown as a flat line on the left side of the slider, or into a high pass filter position, shown on the right side of the slider with an upward trajectory. Preferably, the full frequency response position on the left side of the slider enables the user to engage the active microphone into an unaltered full frequency response without proximity effect-related filtering inside the active ribbon microphone casing.

On the other hand, the high pass filter position on the right side of the slider in the second embodiment (1502) provides a low frequency response filtering or reduction to reduce or eliminate undesirable accentuation of low frequency responses often caused by the proximity effect. Even though the high pass filter position in the second embodiment (1502) is primarily designed to reduce proximity effect associated with a ribbon microphone, this position in the second embodiment (1502) can also be utilized whenever a user desires to create a certain magnitude of low frequency response filtering from the active microphone casing for an application that finds low frequency response filtering desirable.

Figure 16:
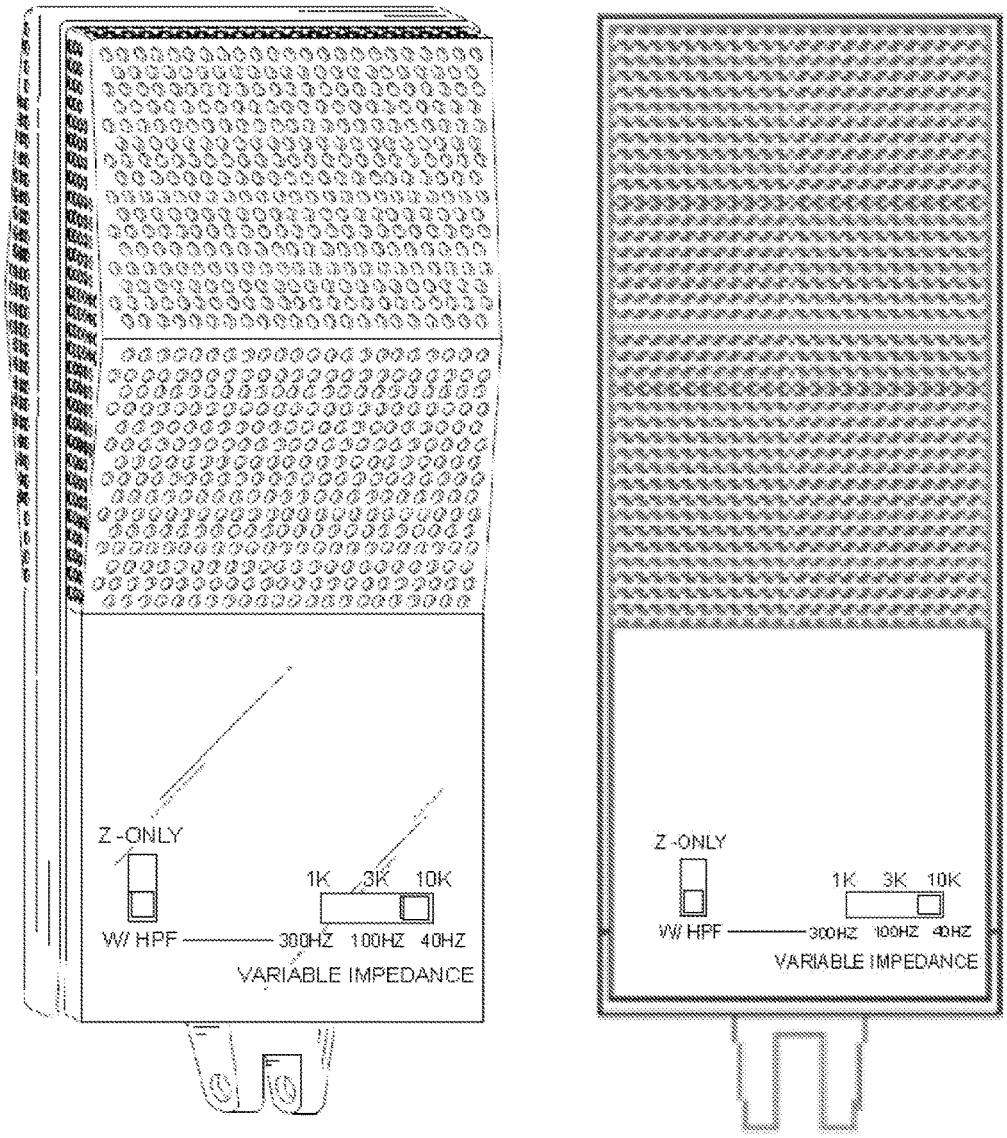
FIG. 16 shows several views of an active ribbon microphone casing which incorporates a phantom-powered inline preamplifier, a slider-based variable impedance loading adjustment interface, and a high-pass filter adjustment interface, in accordance with an embodiment of the invention.

FIG. 16 shows several views (1600A, 1600B) of an active ribbon microphone casing which incorporates a phantom-powered inline preamplifier, a slider-based variable impedance loading adjustment interface, and a high-pass filter adjustment interface, in accordance with an embodiment of the invention. In this embodiment of the invention, variable impedance loading is related to resistive impedance-based variable loading effects, wherein one or more resistors and a potentiometer operatively connected to an adjustable interface (i.e. a slider) change resistive input impedance of the integrated phantom-powered inline preamplifier inside the active ribbon microphone casing.

In this embodiment of the invention, the slider on a surface of the active ribbon microphone casing is configured to slide from a lowest impedance loading setting (i.e. 1 k-ohms) to a highest impedance loading setting (i.e. 10 k-ohms). The slider may be designed as a continuously-sliding interface, in which the variable impedance loading adjustment can be continuously swept from the lowest impedance loading setting to the highest impedance loading setting. In another embodiment of the invention, the slider may simply be set to several preset positions along the slider's path (e.g. 1 k-ohms, 3 k-ohms, 10 k-ohms, and etc.).

Furthermore, in the embodiment of the invention as shown in FIG. 16, a slider for variable high-pass filter on the surface of the active ribbon microphone casing is configured to slide to multiple positions (e.g. impedance (Z)-only mode, HPF enable mode (W/ HPF), HPF adjustment for cutoff values of 40 Hz, 100 Hz, 300 Hz, and etc.) to adjust values of the variable high-pass filter. In this embodiment of the invention, the slider used as a high-pass filter adjustment interface on the active ribbon microphone with the integrated phantom-powered inline preamplifier may provide a bass-range reduction or cut (e.g. frequency reduction or cut below 40 Hz, 100 Hz, 300 Hz), if the high-pass filter is enabled.

In one embodiment of the invention, changing an impedance loading value (e.g. 1 k-ohms, 3 k-ohms, 10 k-ohms, and etc.) also impacts the cutoff values for the high pass filter. For example, setting the variable impedance loading value to 1 k-ohms may have an effect on the high pass filter to make its cutoff value be somewhere around 300 Hz, if the high pass filter is turned on. Likewise, setting the variable impedance loading value to 10 k-ohms may have an effect on the high pass filter to make its cutoff value be somewhere around 40 Hz, if the high pass filter is turned on.

Figure 17:
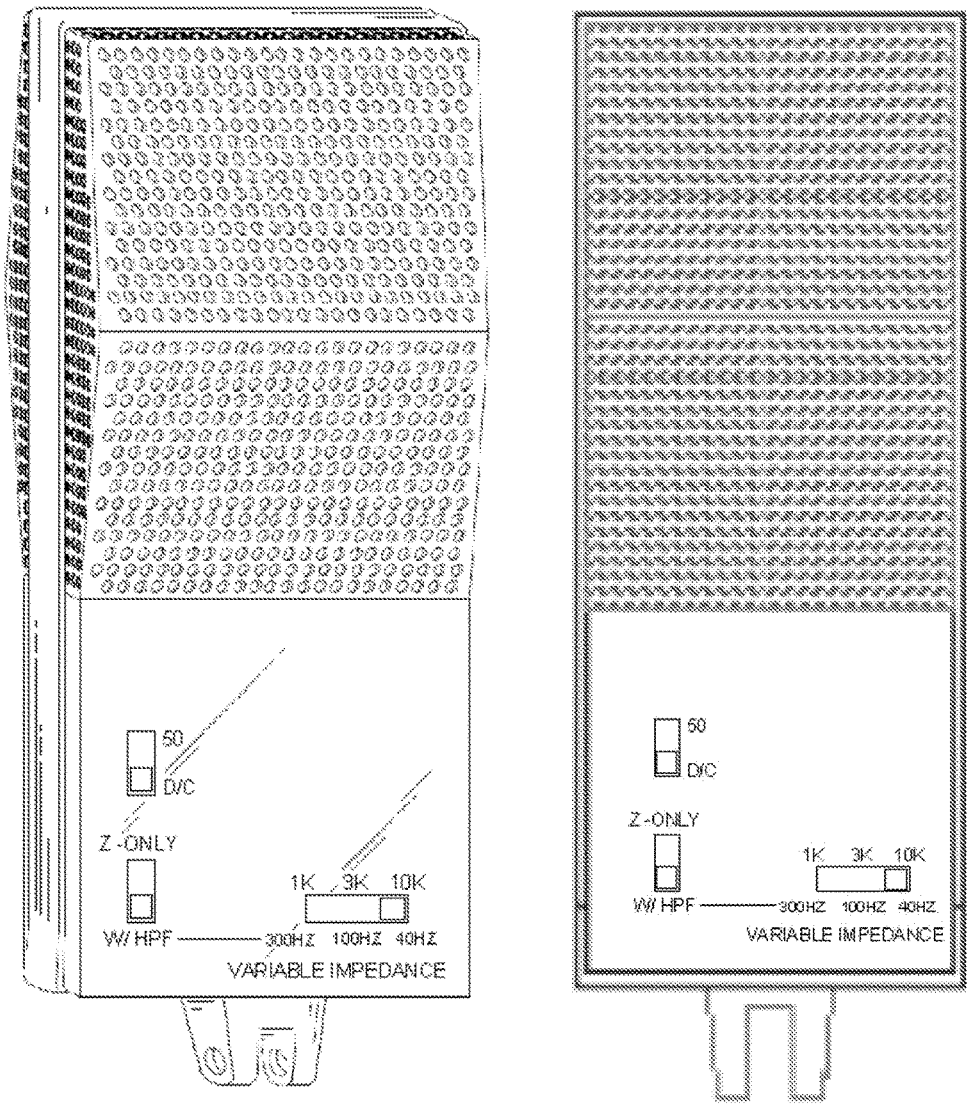
FIG. 17 shows several views of an active ribbon microphone casing which incorporates a phantom-powered inline preamplifier, a slider-based variable impedance loading adjustment interface, a high-pass filter adjustment interface, and a transformer impedance matching interface, in accordance with an embodiment of the invention.

FIG. 17 shows several views (1700A, 1700B) of an active ribbon microphone casing which incorporates a phantom-powered inline preamplifier, a slider-based variable impedance loading adjustment interface, a high-pass filter adjustment interface, and an optional transformer impedance matching interface, in accordance with an embodiment of the invention. In this embodiment of the invention, variable impedance loading is related to resistive impedance-based variable loading effects, wherein one or more resistors and/or a potentiometer operatively connected to an adjustable interface (i.e. a slider) change resistive input impedance of the integrated phantom-powered inline preamplifier inside the active ribbon microphone casing. In a D/C mode, the transformer is bypassed and impedance is controlled resistively by the slider.

In this embodiment of the invention, the slider on a surface of the active ribbon microphone casing is configured to slide from a lowest impedance loading setting (i.e. 1 k-ohms) to a highest impedance loading setting (i.e. 10 k-ohms). The slider may be designed as a continuously-sliding interface, in which the variable impedance loading adjustment can be continuously swept from the lowest impedance loading setting to the highest impedance loading setting. In another embodiment of the invention, the slider may simply be set to several preset positions along the slider's path (e.g. 1 k-ohms, 3 k-ohms, 10 k-ohms, and etc.).

Furthermore, in the embodiment of the invention as shown in FIG. 17, a slider for variable high-pass filter on the surface of the active ribbon microphone casing is configured to slide to multiple positions (e.g. impedance (Z)-only mode, HPF enable mode (W/ HPF), HPF adjustment for cutoff values of 40 Hz, 100 Hz, 300 Hz, and etc.) to adjust values of the variable high-pass filter. In this embodiment of the invention, the slider used as a high-pass filter adjustment interface on the active ribbon microphone with the integrated phantom-powered inline preamplifier may provide a bass-range reduction or cut (e.g. frequency reduction or cut below 40 Hz, 100 Hz, or 300 Hz), if the high-pass filter is enabled.

In one embodiment of the invention, changing an impedance loading value (e.g. 1 k-ohms, 3 k-ohms, 10 k-ohms, and etc.) also impacts the cutoff values for the high pass filter. For example, setting the variable impedance loading value to 1 k-ohms may have an effect on the high pass filter to make its cutoff value be somewhere around 300 Hz, if the high pass filter is turned on. Likewise, setting the variable impedance loading value to 10 k-ohms may have an effect on the high pass filter to make its cutoff value be somewhere around 40 Hz, if the high pass filter is turned on.

In addition, the active ribbon microphone casing as shown in FIG. 17 also has a transformer impedance matching interface with several modes of operation, including a direct-coupled (DC) mode, and a 50 ohm microphone mode. This provides the user a choice between a transformer-based impedance matching (50 ohm transformer impedance matching) and a direct coupling (DC) to the integrated inline phantom-powered preamplifier to allow resistive impedance matching. Providing this selectivity between the two modes may be useful because the sound characteristics are influenced by the transformer, which can be desirable in some applications. By having a D/C mode which enables resistive impedance adjustments using the variable impedance interface (i.e. instead of transformer-based impedance matching), various embodiments of the present invention, including an embodiment shown in FIG. 17, provides flexible impedance adjustment options.

Figure 18:
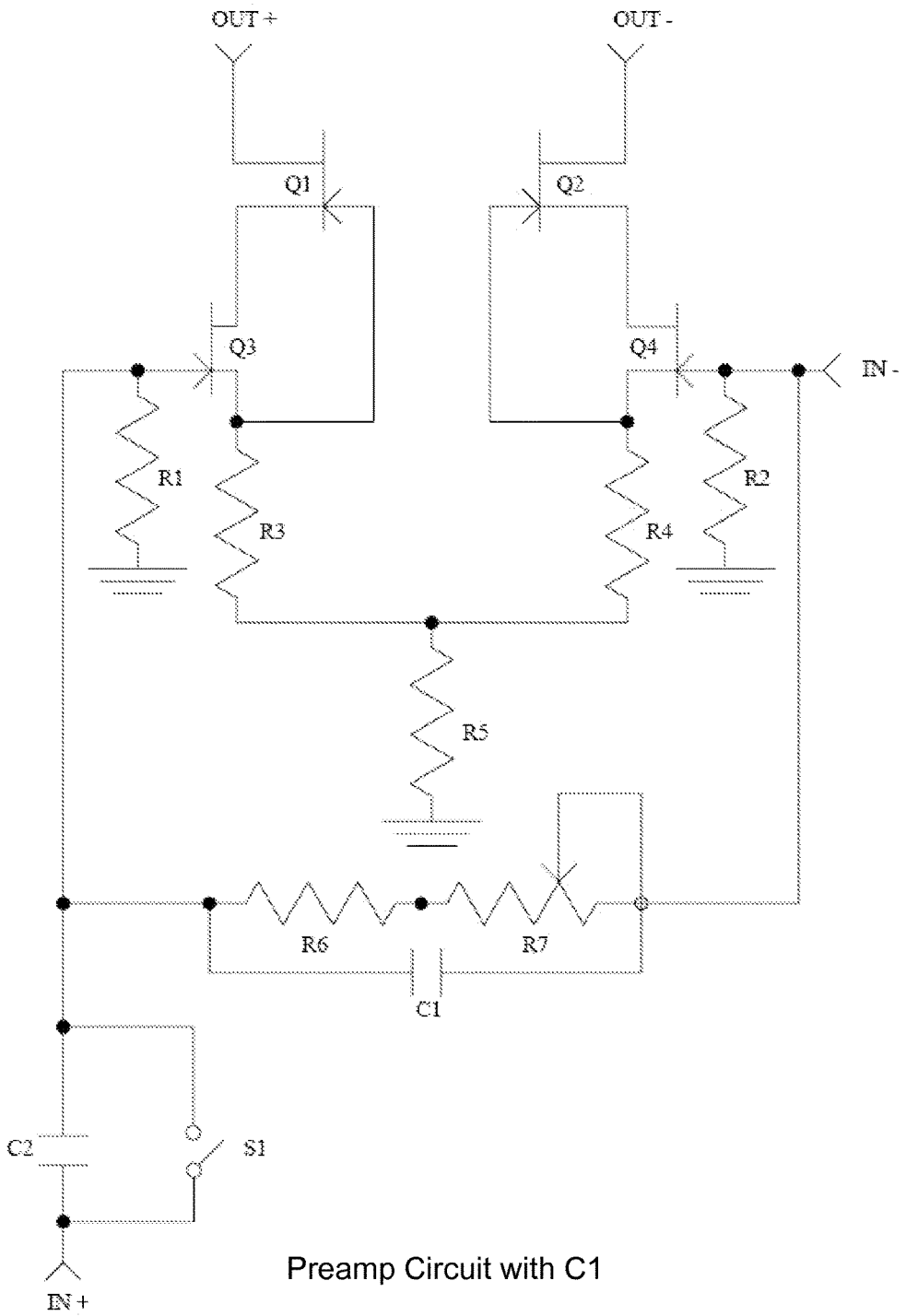
FIG. 18 shows an example of a circuit schematic for a phantom-powered inline preamplifier capable of variable impedance loading adjustment and high-pass filtering, in accordance with an embodiment of the invention.

FIG. 18 shows an example of a circuit schematic (1800) for a phantom-powered inline preamplifier capable of variable impedance loading adjustment and high-pass filtering, in accordance with an embodiment of the invention. This embodiment includes a phantom-powered preamplifier gain circuit unit. In this embodiment of the invention, the circuit schematic shows a phantom-powered inline preamplifier circuit with Q1 and Q2 transistors which are connected to output terminals (e.g. for loading phantom power and/or other components). Q3 and Q4 transistors are operatively connected to the input terminals and Q1 and Q2 transistors and provide a desirable amount of signal gain for the input signals to the input terminals. In a preferred embodiment of the invention, the circuit schematic (1800) further includes a resistor-capacitor (RC) network comprising resistors (R6, R7) and a capacitor (C1). This RC network enables the phantom-powered inline preamplifier circuit to be used as an external box powered by a +48V power supply in a microphone input device without radio frequency interference associated with a cable length. Furthermore, the capacitor (C1) acts as an RF shunt capacitor configured to suppress RF interferences when the wiring for a transformer-to-circuit input is long or poorly shielded by acting as an electrical dead short at radio frequencies.

The circuit schematic (1800) in FIG. 18 also includes a series capacitor (C2), a bypass switch (S1), and a potentiometer (R7) to the input circuitry. The capacitor (C2) acts as a high pass filter, which is bypassable via the switch (S1). The potentiometer (R7) varies the resistive impedance loading, which may also function as a variable high pass control when the capacitor is not bypassed, and also as a variable load to the microphone that allows the user to vary the microphone sound according to the characteristics of the microphone's output transformer.

Figure 19:
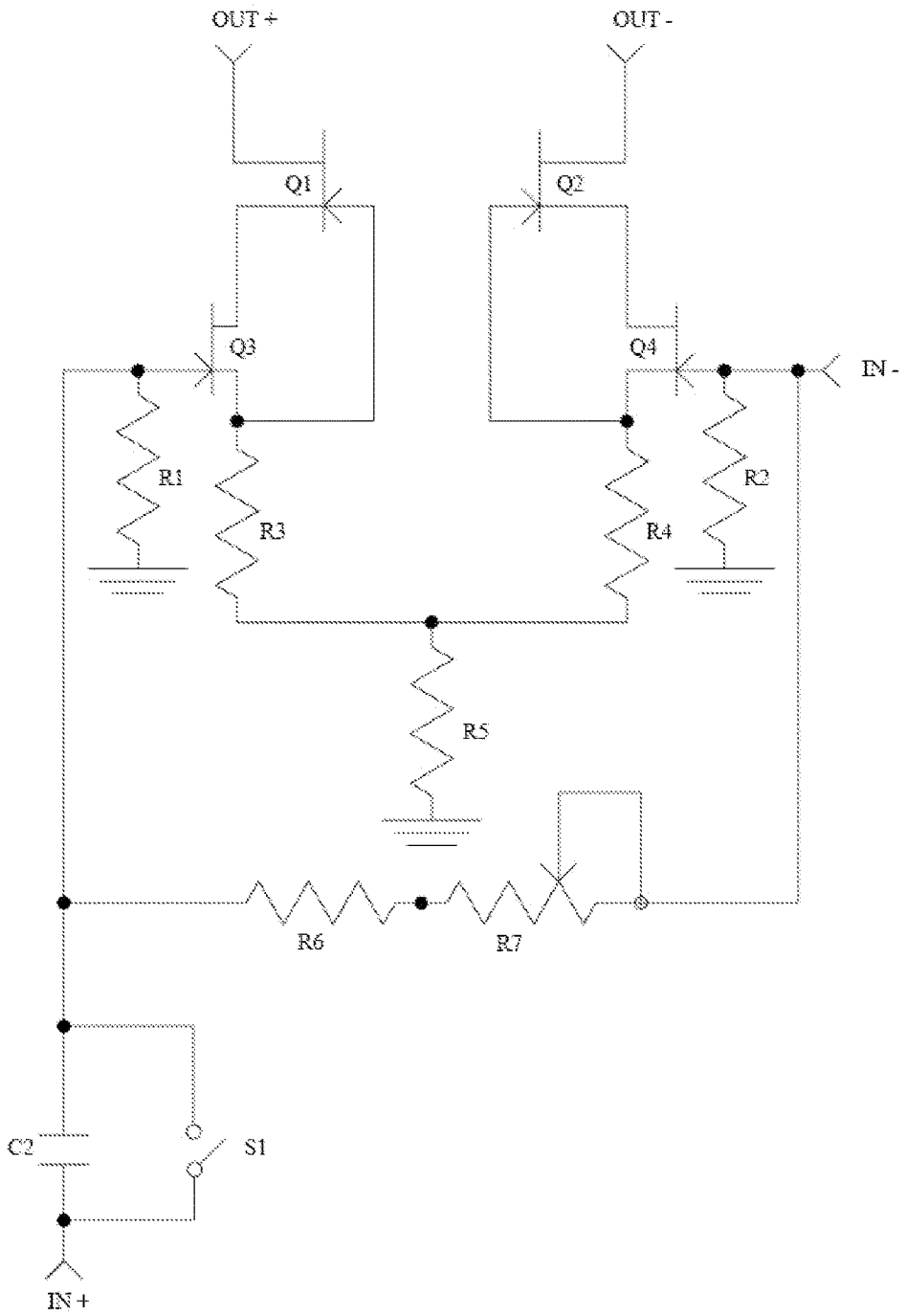
FIG. 19 shows an example of another circuit schematic for a phantom-powered inline preamplifier capable of variable impedance loading adjustment and high-pass filtering, in accordance with an embodiment of the invention.

FIG. 19 shows an example of another circuit schematic (1900) for a phantom-powered inline preamplifier capable of variable impedance loading adjustment and high-pass filtering, in accordance with an embodiment of the invention. This embodiment includes a phantom-powered preamplifier gain circuit unit. In this embodiment of the invention, the circuit schematic for the phantom-powered inline preamplifier is similar to FIG. 18 but does not include an RF shunt capacitor (C1) configured to suppress RF interferences.

Figure 20:
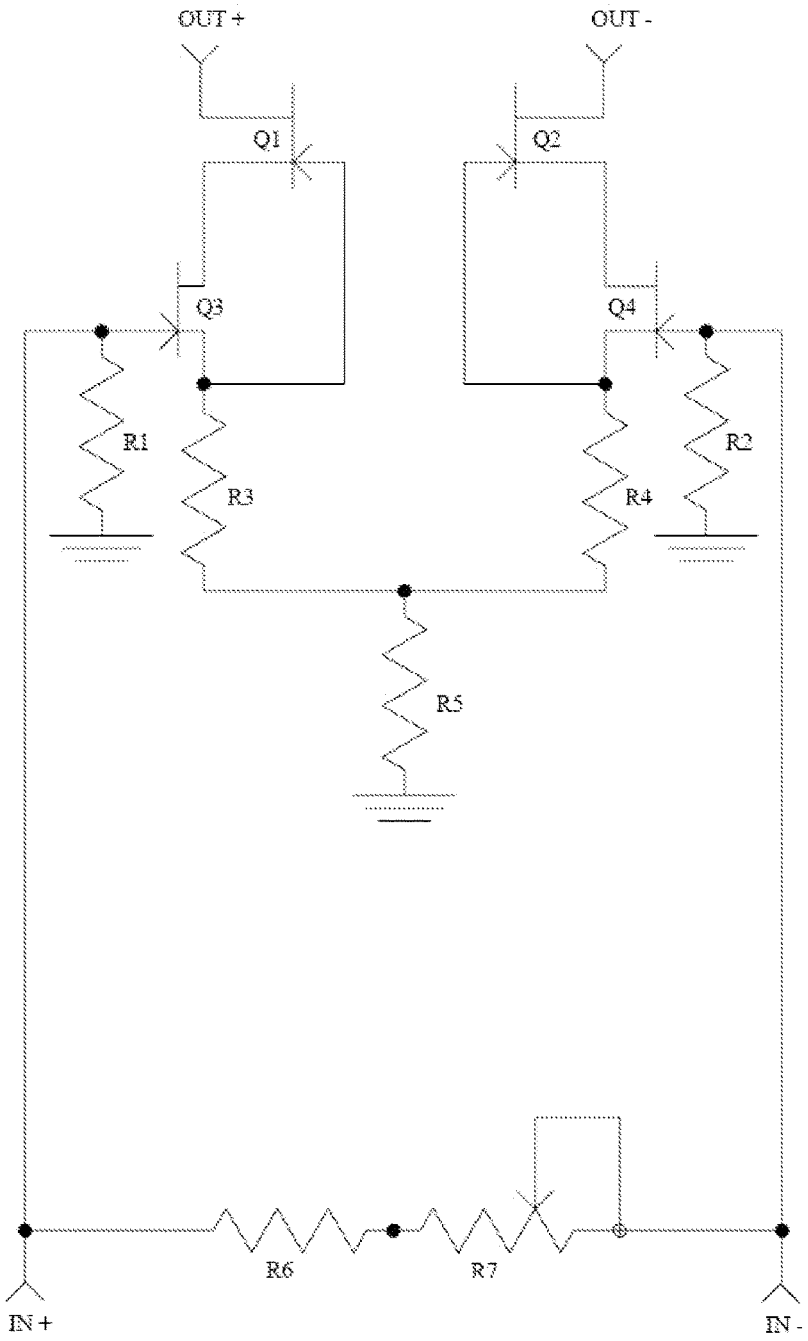
FIG. 20 shows an example of a circuit schematic for a phantom-powered inline preamplifier capable of variable impedance loading adjustment, in accordance with an embodiment of the invention.

FIG. 20 shows an example of another circuit schematic (2000) for a phantom-powered inline preamplifier capable of variable impedance loading adjustment, in accordance with an embodiment of the invention. This embodiment includes a phantom-powered preamplifier gain circuit unit. In this embodiment of the invention, the circuit schematic for the phantom-powered inline preamplifier is similar to FIG. 19 but does not include a high pass filter (e.g. C2, S1) operatively connected to an input terminal.

Figure 21:
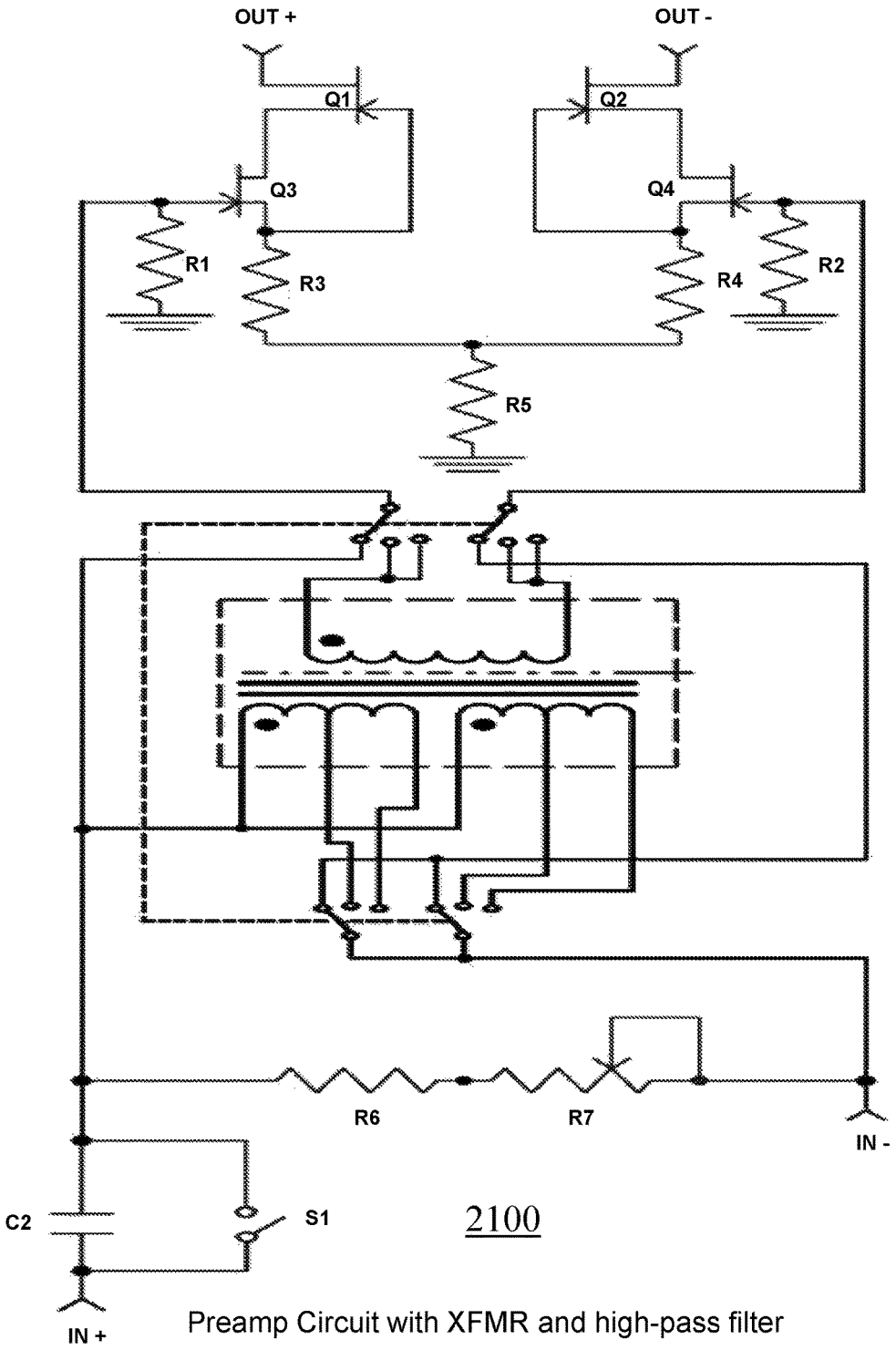
FIG. 21 shows an example of another circuit schematic for a phantom-powered inline preamplifier capable of variable impedance loading adjustment with a high-pass filter and a transformer (XFMR), in accordance with an embodiment of the invention.

FIG. 21 shows an example of another circuit schematic (2100) for a phantom-powered inline preamplifier capable of variable impedance loading adjustment with a high-pass filter and a transformer (XFMR), in accordance with an embodiment of the invention. This embodiment includes a phantom-powered preamplifier gain circuit unit. In this embodiment of the invention, the circuit schematic for the phantom-powered inline preamplifier is similar to FIG. 19 but additionally include a transformer (XFMR) operatively connected to input terminals, the high-pass filter, and the gates of Q3 and Q4 transistors.

Figure 22:
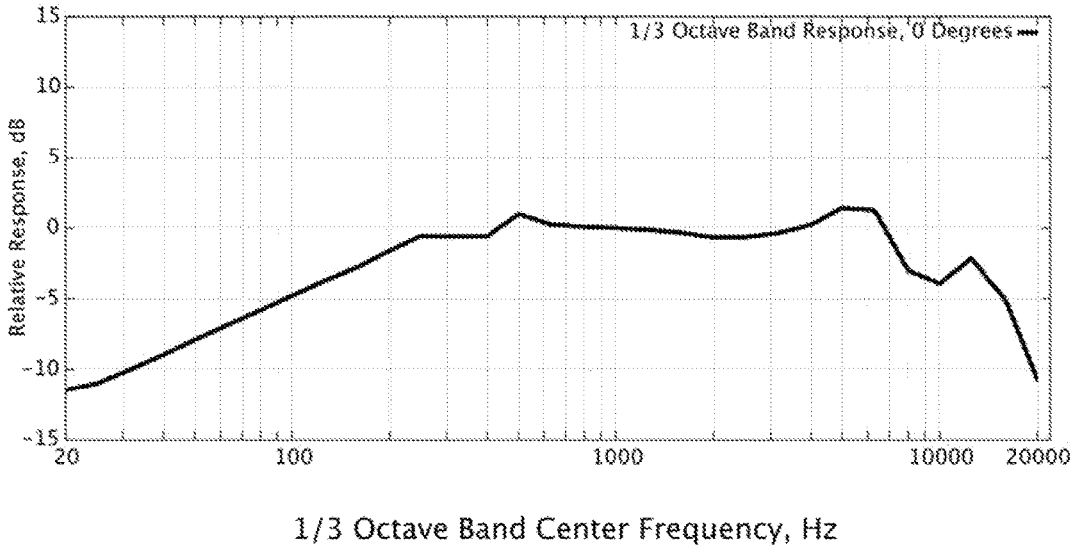
FIG. 22 shows an example of a "Voice" mode activated from a voice mode adjustment interface on an active ribbon microphone casing to achieve proximity effect response filtering and bass frequency response reduction.

FIG. 22 shows an example of a "Voice" mode activated from a voice mode adjustment interface on an active ribbon microphone casing to achieve proximity effect response filtering and bass frequency response reduction. As shown in a graph (2200) for the ⅓ octave band response over a range of frequencies, when the "Voice" mode is activated from the voice mode adjustment interface, such as the slider-based music or voice mode adjustment interface, a high pass filter is activated to reduce low frequency responses. In the graph (2200) for the ⅓ octave band response over a range of frequencies, the voice mode reduces bass frequency responses approximately below 300 Hz. A specific point where the bass frequency response reduction occurs depends on a particular user setting from the voice mode adjustment interface.

Figure 23:
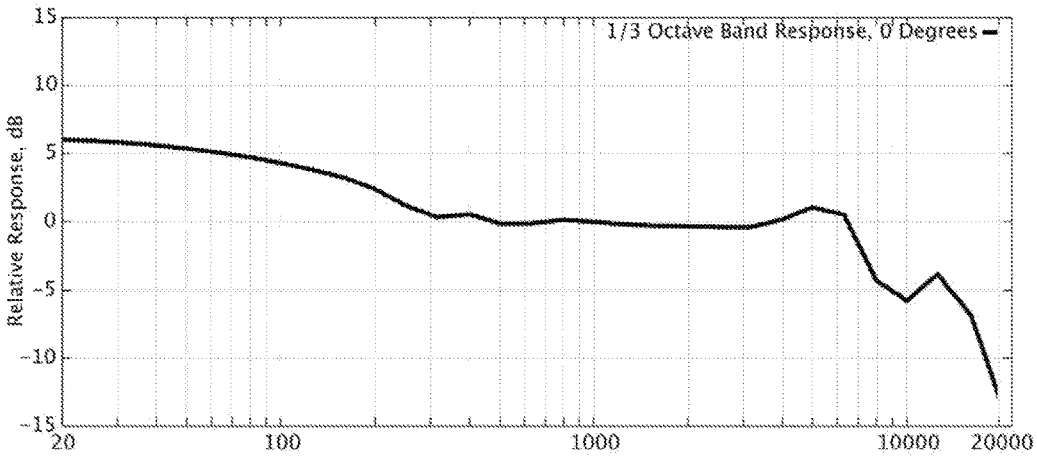
FIG. 23 shows an example of a "Music" mode activated from a music or voice mode adjustment interface on an active ribbon microphone casing to achieve a full frequency response from the active ribbon microphone without bass frequency response reduction.

FIG. 23 shows an example of a "Music" mode activated from a music or voice mode adjustment interface on an active ribbon microphone casing to achieve a full frequency response from the active ribbon microphone without bass frequency response reduction. In contrast to the graph (2200) of FIG. 22, which showed the bass frequency response reduction and proximity effect response filtering at approximately 300 Hz or below, the "Music" mode in FIG. 23 shows the full frequency response, with the bass frequencies having naturally-elevated responses at approximately 300 Hz or below. The "Music" mode and the "Voice" mode may be switched back and forth using sliders and/or knobs, such as a slider-based full frequency response vs. low frequency response and high pass filtering adjustment interface, and a slider-based or a knob-based variable voice mode adjustment interface, as previously shown by FIG. 11, for example.

Figure 24:
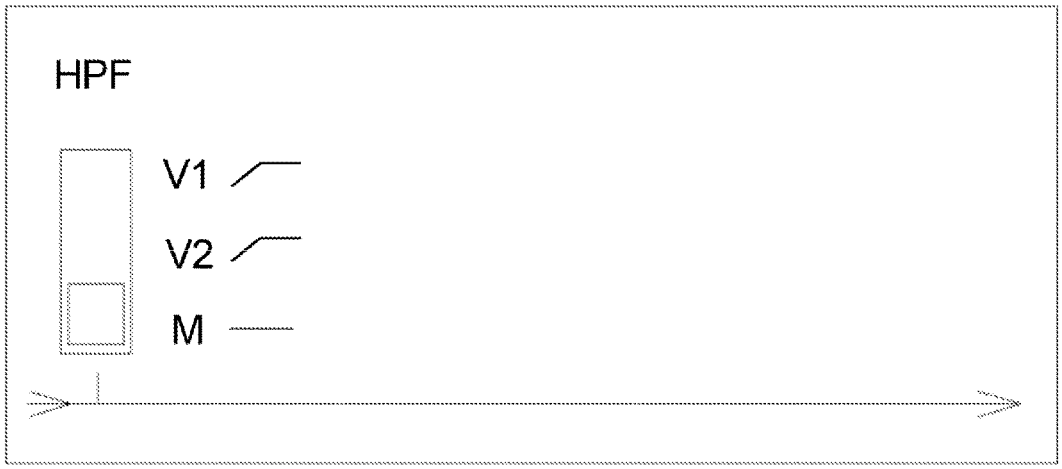
FIG. 24 shows a slider-based music or voice mode adjustment interface on a surface of a standalone phantom-powered inline preamplifier unit, in accordance with an embodiment of the invention.

FIG. 24 shows a slider-based music or voice mode adjustment interface on a surface of a standalone phantom-powered inline preamplifier unit, in accordance with an embodiment of the invention. In this embodiment (2400) of the invention, the slider-based music or voice mode adjustment interface operates for the standalone phantom-powered inline preamplifier unit. Preferably, this embodiment (2400) of the invention, as shown in FIG. 24, incorporates a slider on a surface of the standalone phantom-powered inline preamplifier unit. This slider is configured to slide into a music-mode position, shown as "M," a first voice-mode position, shown as "V1," or a second voice-mode position, shown as "V2," in this embodiment (2400). Preferably, the music-mode position ("M") provides an unaltered full frequency response without any frequency filtering inside the standalone phantom-powered inline preamplifier unit. On the other hand, the first voice-mode position ("V1") provides a first magnitude of low frequency filtering or reduction to reduce or eliminate undesirable accentuation of low frequency. Likewise, the second voice-mode position ("V2") provides a second magnitude of low frequency filtering or reduction to reduce or eliminate undesirable low frequency signals.

When the slider-based music or voice mode adjustment interface is located on the surface of the standalone phantom-powered inline preamplifier unit, as shown in FIG. 24, the voice modes (i.e. "V1," "V2," and etc.) enable a user to create a certain magnitude of low frequency filtering from the input signal to the standalone phantom-powered inline preamplifier unit for an application that finds low frequency filtering desirable. For example, the user may want to reduce bass or emphasize higher frequency ranges from the input signal (i.e. from a microphone or another sound source) for a vocal performance or playback.

Preferably, the low frequency filtering or reduction for each of the voice modes is provided by a high-pass filter inside the standalone phantom-powered inline preamplifier. Furthermore, in one embodiment of the invention, the first magnitude of low frequency filtering for the first voice-mode position ("V1") may be less than the second magnitude of low frequency filtering for the second voice-mode position ("V2"). In an alternate embodiment of the invention, the first magnitude of low frequency filtering for the first voice-mode position ("V1") may be more than the second magnitude of low frequency filtering for the second voice-mode position ("V2").

Figure 25:
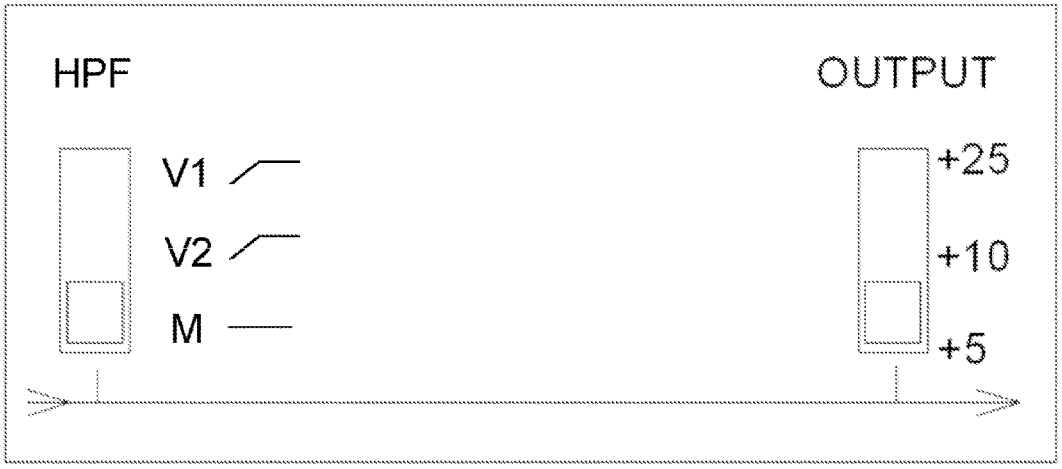
FIG. 25 shows a slider-based music or voice mode adjustment interface and a variable output gain adjustment interface on a surface of a standalone phantom-powered inline preamplifier unit, in accordance with an embodiment of the invention.

FIG. 25 shows a slider-based music or voice mode adjustment interface and a variable output gain adjustment interface on a surface of a standalone phantom-powered inline preamplifier unit, in accordance with an embodiment of the invention. In this embodiment (2500) of the invention, the slider-based music or voice mode adjustment interface operates for the standalone phantom-powered inline preamplifier unit. Preferably, this embodiment (2500) of the invention, as shown in FIG. 25, incorporates a slider on a surface of the standalone phantom-powered inline preamplifier unit. This slider is configured to slide into a music-mode position, shown as "M," a first voice-mode position, shown as "V1," or a second voice-mode position, shown as "V2," in this embodiment (2500). Preferably, the music-mode position ("M") provides an unaltered full frequency response without any frequency filtering inside the standalone phantom-powered inline preamplifier unit. On the other hand, the first voice-mode position ("V1") provides a first magnitude of low frequency filtering or reduction to reduce or eliminate undesirable accentuation of low frequency. Likewise, the second voice-mode position ("V2") provides a second magnitude of low frequency filtering or reduction to reduce or eliminate undesirable low frequency signals.

When the slider-based music or voice mode adjustment interface is located on the surface of the standalone phantom-powered inline preamplifier unit, as shown in FIG. 25, the voice modes (i.e. "V1," "V2," and etc.) enable a user to create a certain magnitude of low frequency filtering from the input signal to the standalone phantom-powered inline preamplifier unit for an application that finds low frequency filtering desirable. For example, the user may want to reduce bass or emphasize higher frequency ranges from the input signal (i.e. from a microphone or another sound source) for a vocal performance or playback.

Preferably, the low frequency filtering or reduction for each of the voice modes is provided by a high-pass filter inside the standalone phantom-powered inline preamplifier. Furthermore, in one embodiment of the invention, the first magnitude of low frequency filtering for the first voice-mode position ("V1") may be less than the second magnitude of low frequency filtering for the second voice-mode position ("V2"). In an alternate embodiment of the invention, the first magnitude of low frequency filtering for the first voice-mode position ("V1") may be more than the second magnitude of low frequency filtering for the second voice-mode position ("V2").

Furthermore, in this embodiment (2500) of the invention, the variable output gain adjustment interface on the surface of the standalone phantom-powered inline preamplifier unit provides a user interface to set a desired output signal gain value (e.g. 5 dB, 10, dB, 25 dB, and etc.) for an output terminal of the standalone phantom-powered inline preamplifier.

Figure 26:
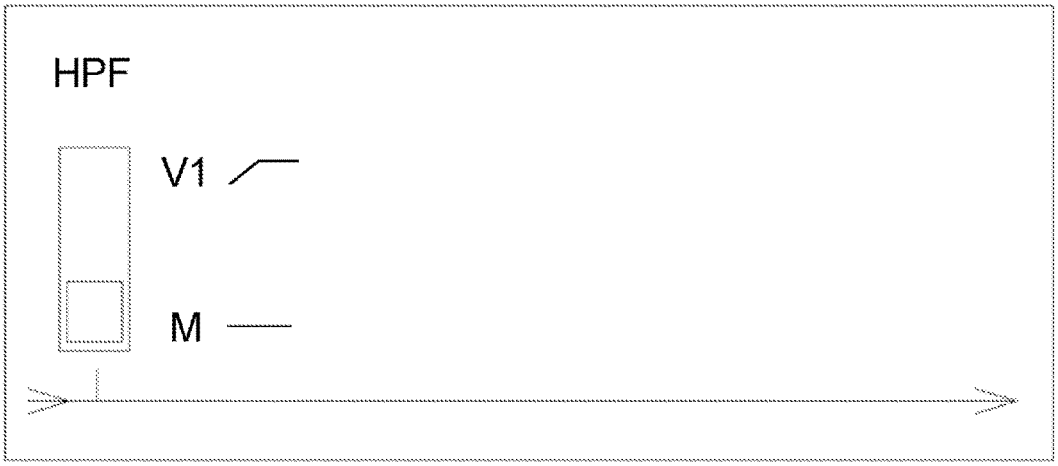
FIG. 26 shows another slider-based music or voice mode adjustment interface on a surface of a standalone phantom-powered inline preamplifier unit, in accordance with an embodiment of the invention.

FIG. 26 shows another slider-based music or voice mode adjustment interface on a surface of a standalone phantom-powered inline preamplifier unit, in accordance with an embodiment of the invention. In this embodiment (2600) of the invention, the slider-based music or voice mode adjustment interface operates for the standalone phantom-powered inline preamplifier unit. Preferably, this embodiment (2600) of the invention, as shown in FIG. 26, incorporates a slider on a surface of the standalone phantom-powered inline preamplifier unit. This slider is configured to slide into a music-mode position, shown as "M," and a voice-mode position, shown as "V1," in this embodiment (2600). Preferably, the music-mode position ("M") provides an unaltered full frequency response without any frequency filtering inside the standalone phantom-powered inline preamplifier unit. On the other hand, the voice-mode position ("V1") provides a first magnitude of low frequency filtering or reduction to reduce or eliminate undesirable accentuation of low frequency.

When the slider-based music or voice mode adjustment interface is located on the surface of the standalone phantom-powered inline preamplifier unit, as shown in FIG. 26, the voice mode (i.e. "V1") enables a user to create a certain magnitude of low frequency filtering from the input signal to the standalone phantom-powered inline preamplifier unit for an application that finds low frequency filtering desirable. For example, the user may want to reduce bass or emphasize higher frequency ranges from the input signal (i.e. from a microphone or another sound source) for a vocal performance or playback. Preferably, the low frequency filtering or reduction for the voice mode is provided by a high-pass filter inside the standalone phantom-powered inline preamplifier.

Figure 27:
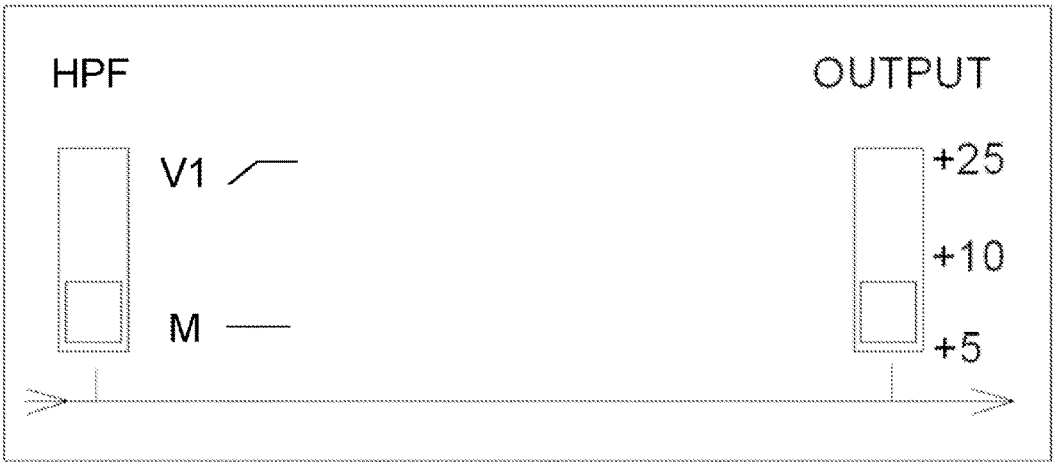
FIG. 27 shows another slider-based music or voice mode adjustment interface and a variable output gain adjustment interface on a surface of a standalone phantom-powered inline preamplifier unit, in accordance with an embodiment of the invention.

FIG. 27 shows another slider-based music or voice mode adjustment interface and a variable output gain adjustment interface on a surface of a standalone phantom-powered inline preamplifier unit, in accordance with an embodiment of the invention. In this embodiment (2700) of the invention, the slider-based music or voice mode adjustment interface operates for the standalone phantom-powered inline preamplifier unit. Preferably, this embodiment (2700) of the invention, as shown in FIG. 27, incorporates a slider on a surface of the standalone phantom-powered inline preamplifier unit. This slider is configured to slide into a music-mode position, shown as "M," and a voice-mode position, shown as "V1," in this embodiment (2700). Preferably, the music-mode position ("M") provides an unaltered full frequency response without any frequency filtering inside the standalone phantom-powered inline preamplifier unit. On the other hand, the voice-mode position ("V1") provides a magnitude of low frequency filtering or reduction to reduce or eliminate undesirable accentuation of low frequency.

When the slider-based music or voice mode adjustment interface is located on the surface of the standalone phantom-powered inline preamplifier unit, as shown in FIG. 27, the voice mode (i.e. "V1") enable a user to create a certain magnitude of low frequency filtering from the input signal to the standalone phantom-powered inline preamplifier unit for an application that finds low frequency filtering desirable. For example, the user may want to reduce bass or emphasize higher frequency ranges from the input signal (i.e. from a microphone or another sound source) for a vocal performance or playback.

Preferably, the low frequency filtering or reduction for the voice mode is provided by a high-pass filter inside the standalone phantom-powered inline preamplifier. Furthermore, in this embodiment (2700) of the invention, the variable output gain adjustment interface on the surface of the standalone phantom-powered inline preamplifier unit provides a user interface to set a desired output signal gain value (e.g. 5 dB, 10, dB, 25 dB, and etc.) for an output terminal of the standalone phantom-powered inline preamplifier.

Various embodiments of the present invention describe a user-adjustable interface on a surface of an active microphone casing to switch between a "Music" mode and a "Voice" mode, which changes frequency response characteristics of the microphone inside the active microphone casing. Furthermore, various embodiments of the invention also describe another user-adjustable interface that can be used in conjunction with the "Music" mode or the "Voice" mode on a surface of an active microphone casing to fine-tune proximity effect response filtering and adjust bass frequency reduction thresholds. The user is able to alter the active microphone's voicing characteristics with these novel user-adjustable interfaces, and is also able to optimize the sound of the active microphone prior to further amplification processing outside the microphone casing.

This is especially useful for an active ribbon microphone, which typically suffers from the proximity effect. It should be noted that some musicians or vocalists prefer keeping their microphone very close to the sound source (e.g. instruments, vocal chords, and etc.) during recording or performances, because keeping the microphone close to the sound source generally minimizes chances of ambient or background noise pickup. However, because conventional ribbon microphones suffer from proximity effect, a novel solution, as presented in various embodiments of the presented invention, may be highly desirable.

One or more embodiments of the present invention, for example, allows a sound source situated very close to the casing of the active ribbon microphone to experience reduction in exaggerated low frequency response in the active ribbon microphone caused by the proximity effect. By selecting a particular mode and/or a particular low frequency reduction point from the user-adjustable interfaces, as shown in FIG. 9, FIG. 10, FIG. 11, FIG. 12, and FIG. 15, the user is able to achieve a desirable frequency response across all audible frequency spectrum, regardless of the distance between a sound source (e.g. the acoustic guitar) and the casing of the active ribbon microphone.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An integrated phantom-powered inline preamplifier with proximity effect response filtering inside an active ribbon or dynamic microphone casing, the integrated phantom-powered inline preamplifier comprising:

a set of input terminals coupled to the active ribbon or dynamic microphone casing, wherein the set of input terminals are configured to receive a microphone electrical signal from a passive circuitry in the active ribbon or dynamic microphone casing, and wherein the set of input terminals is also coupled to one or more transistors inside the integrated phantom-powered inline preamplifier;

a set of output terminals configured to load phantom power and also configured to transmit an amplified signal from the microphone electrical signal, wherein the set of output terminals is coupled to the one or more transistors inside the integrated phantom-powered inline preamplifier;

a phantom-powered preamplifier gain circuit comprising at least one of the one or more transistors and a resistor-capacitor network;

a full frequency response and low frequency response adjustment interface that activates a full frequency response mode or a high-pass filter mode; and a high-pass filter circuit coupled to the full frequency response and low frequency response adjustment interface, wherein the high-pass filter circuit is integrated inside the active ribbon or dynamic microphone casing.

2. The integrated phantom-powered inline preamplifier of claim 1, further comprising a slider-based, a switch-based, or a knob-based variable voice mode adjustment interface on a surface of the active ribbon or dynamic microphone casing to achieve varying levels of proximity effect response filtering and bass frequency reduction.

3. The integrated phantom-powered inline preamplifier of claim 2, wherein the varying levels of proximity effect response filtering and bass frequency reduction occur at 30 Hz, 40 Hz, 50 Hz, 100 Hz, or 300 Hz, which are adjustable by the slider-based, the switch-based, or the knob-based variable voice mode adjustment interface.

4. The integrated phantom-powered inline preamplifier of claim 1, further comprising a variable impedance loading adjustable interface that enables a user to select a particular impedance loading value among a plural selection of impedance loading values available on the variable impedance loading adjustable interface, wherein the user selecting the particular impedance loading value causes a user-specified adjustment of an input impedance and/or an internal impedance of the integrated phantom-powered inline preamplifier for user-desired sound characteristics achieved by varying impedance loading.

5. The integrated phantom-powered inline preamplifier of claim 4, wherein the variable impedance loading adjustable interface is coupled to one or more resistors and a potentiometer to change a resistive input impedance of the integrated phantom-powered inline preamplifier.

6. The integrated phantom-powered inline preamplifier of claim 4, wherein the variable impedance loading adjustable interface is a knob, a slider, a roller, or a switch that enables the user to select the particular impedance loading value among the plural selection of impedance loading values.

7. The integrated phantom-powered inline preamplifier of claim 6, wherein the knob, the slider, or the roller is a sweeping interface configured to be continuously swept from a lowest impedance loading setting to a highest impedance loading setting in the variable impedance loading adjustable interface.

8. The integrated phantom-powered inline preamplifier of claim 4, wherein the plural selection of impedance loading values include 150 ohms, 1 kilo-ohms, 3 kilo-ohms, 10 kilo-ohms, and 15 kilo-ohms.

9. The integrated phantom-powered inline preamplifier of claim 4, wherein the plural selection of impedance loading values include 500 ohms, 3 kilo-ohms, and 10 kilo-ohms.

10. The integrated phantom-powered inline preamplifier of claim 4, further comprising an additional adjustable interface for variable transformer impedance matching.

11. The integrated phantom-powered inline preamplifier of claim 4, further comprising an additional adjustable interface for variable output gain setting to set a desired output signal gain value.

12. The integrated phantom-powered inline preamplifier of claim 4, wherein the phantom power is supplied by a secondary preamplifier coupled to the integrated phantom-powered inline preamplifier, and wherein the phantom power is 48 DC Volts or 24 DC Volts.

13. A standalone phantom-powered inline preamplifier with proximity effect response filtering, the standalone phantom-powered inline preamplifier comprising:

a set of input terminals on a casing of the standalone phantom-powered inline preamplifier, wherein the set of input terminals are configured to receive a sound source electrical signal from a microphone, and wherein the set of input terminals is coupled to one or more transistors inside the standalone phantom-powered inline preamplifier;

a set of output terminals configured to load phantom power and also configured to transmit an amplified signal from the sound source electrical signal, wherein the set of output terminals is coupled to the one or more transistors inside the standalone phantom-powered inline preamplifier;

a phantom-powered preamplifier gain circuit comprising at least one of the one or more transistors and a resistor-capacitor network;

a full frequency response and low frequency response adjustment interface that activates a full frequency response mode or a high-pass filter mode; and a high-pass filter circuit coupled to the full frequency response and low frequency response adjustment interface, wherein the high-pass filter circuit is integrated inside the standalone phantom-powered inline preamplifier.

14. The standalone phantom-powered inline preamplifier of claim 13, further comprising an additional adjustable interface for variable output gain setting to set a desired output signal gain value.

15. The standalone phantom-powered inline preamplifier of claim 13, wherein the phantom power is supplied by a power source or another amplifier coupled to the standalone phantom-powered inline preamplifier, and wherein the phantom power is 48 DC Volts or 24 DC Volts.

16. The standalone phantom-powered inline preamplifier of claim 13, wherein the full frequency response and low frequency response adjustment interface utilizes a switch, a slider, a knob, or a roller for a switchable or sweeping adjustment.

17. The standalone phantom-powered inline preamplifier of claim 13, further comprising a slider-based, a switch-based, or a knob-based variable voice mode adjustment interface on a surface of the casing of the standalone phantom-powered inline preamplifier to achieve varying levels of the proximity effect response filtering and bass frequency reduction.

18. The standalone phantom-powered inline preamplifier of claim 17, wherein the varying levels of the proximity effect response filtering and bass frequency reduction occur at 30 Hz, 40 Hz, 50 Hz, 100 Hz, or 300 Hz, which are adjustable by the slider-based, the switch-based, or the knob-based variable voice mode adjustment interface.

19. The standalone phantom-powered inline preamplifier of claim 13, further comprising a variable impedance loading adjustable interface that enables a user to select a particular impedance loading value among a plural selection of impedance loading values available on the variable impedance loading adjustable interface, wherein the user selecting the particular impedance loading value causes a user-specified adjustment of an input impedance and/or an internal impedance of the integrated phantom-powered inline preamplifier for user-desired sound characteristics achieved by varying impedance loading.

20. The standalone phantom-powered inline preamplifier of claim 19, wherein the variable impedance loading adjustable interface is a knob, a slider, a roller, or a switch that enables the user to select the particular impedance loading value among the plural selection of impedance loading values.

* * * * *